US011181844B2

(12) United States Patent
Nagaoka et al.

(10) Patent No.: US 11,181,844 B2
(45) Date of Patent: Nov. 23, 2021

(54) TONER AND METHOD OF PRODUCING TONER

(71) Applicant: CANON KABUSHIKI KAISHA, Tokyo (JP)

(72) Inventors: Tomoya Nagaoka, Tokyo (JP); Daisuke Yoshiba, Suntou-gun (JP); Kazuyuki Sato, Yokohama (JP); Yuta Komiya, Suntou-gun (JP); Tomohisa Sano, Mishima (JP); Takashi Matsui, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/880,017

(22) Filed: May 21, 2020

(65) Prior Publication Data

US 2020/0379363 A1 Dec. 3, 2020

(30) Foreign Application Priority Data

May 28, 2019 (JP) ..... JP2019-099365

(51) Int. Cl.
*G03G 9/08* (2006.01)
*G03G 9/097* (2006.01)
*G03G 9/087* (2006.01)

(52) U.S. Cl.
CPC ..... *G03G 9/09725* (2013.01); *G03G 9/0806* (2013.01); *G03G 9/08711* (2013.01); *G03G 9/08755* (2013.01)

(58) Field of Classification Search
CPC ..... G03G 9/08711; G03G 9/09725
USPC ..... 430/109.3
See application file for complete search history.

(56) References Cited

U.S. PATENT DOCUMENTS 7,123,862 B2 10/2006 Hasegawa et al.
7,537,877 B2 5/2009 Yoshiba et al.
7,544,455 B2 6/2009 Yoshiba et al.
7,582,401 B2 9/2009 Ogawa et al.
7,678,523 B2 3/2010 Hiroko et al.
7,678,524 B2 3/2010 Hasegawa et al.
7,700,254 B2 4/2010 Moribe et al.
7,740,998 B2 6/2010 Yamazaki et al.
7,796,926 B2 9/2010 Matsuda et al.
7,842,446 B2 11/2010 Yanase et al.
7,855,042 B2 12/2010 Kobori et al.
7,923,190 B2 4/2011 Magome et al.
7,935,467 B2 5/2011 Dojo et al.
8,057,977 B2 11/2011 Moribe et al.
8,227,162 B2 7/2012 Sano et al.
8,426,091 B2 4/2013 Magome et al.
8,426,094 B2 4/2013 Magome et al.
8,518,620 B2 8/2013 Dojo et al.
8,614,044 B2 12/2013 Matsui et al.
8,778,585 B2 7/2014 Matsui et al.
8,841,054 B2 9/2014 Dojo et al.
8,883,389 B2 11/2014 Matsui et al.
9,097,997 B2 8/2015 Nomura et al.
9,097,998 B2 8/2015 Yamazaki et al.
9,128,400 B2 9/2015 Takahashi et al.
9,152,065 B2 10/2015 Sano et al.
9,201,323 B2 12/2015 Nishikawa et al.
9,213,250 B2 12/2015 Nomura et al.
9,217,943 B2 12/2015 Matsui et al.
9,235,151 B2 1/2016 Tanaka et al.
9,239,528 B2 1/2016 Hasegawa et al.
9,250,548 B2 2/2016 Nomura et al.
9,261,804 B2 2/2016 Yamazaki et al.
9,304,422 B2 4/2016 Matsui et al.
9,341,970 B2 5/2016 Yoshiba et al.
9,348,246 B2 5/2016 Magome et al.
9,354,545 B2 5/2016 Matsui et al.
9,377,708 B2 6/2016 Magome et al.
9,442,416 B2 9/2016 Magome et al.
9,442,419 B2 9/2016 Wakabayashi et al.
9,551,947 B2 1/2017 Hiroko et al.
9,581,934 B2 2/2017 Ito et al.
9,606,462 B2 3/2017 Nomura et al.
9,658,546 B2 5/2017 Tanaka et al.
9,804,514 B2 10/2017 Suzumura et al.
9,804,519 B2 10/2017 Suzumura et al.
9,829,818 B2 11/2017 Yoshiba et al.
9,841,692 B2 12/2017 Hasegawa et al.
9,857,707 B2 1/2018 Tsuda et al.
9,904,195 B2 2/2018 Matsui et al.
9,927,728 B2 3/2018 Arimura et al.
9,946,179 B2 4/2018 Arimura et al.
9,946,181 B2 4/2018 Hasegawa et al.
9,964,874 B2 5/2018 Suzumura et al.
9,964,881 B2 5/2018 Ikejiri et al.
9,971,262 B2 5/2018 Hasegawa et al.
9,971,263 B2 5/2018 Fukudome et al.
9,971,264 B2 5/2018 Sano et al.
(Continued)

FOREIGN PATENT DOCUMENTS

JP 2014-130243 7/2014
WO 2018/110593 6/2018

OTHER PUBLICATIONS

Fedors, "A Method for Estimating Both the Solubility Parameters and Molar Volumes of Liquids", Polymer Engineering and Science, vol. 14, No. 2 (1974) 147-54.
(Continued)

*Primary Examiner* — Mark A Chapman
(74) *Attorney, Agent, or Firm* — Venable LLP

(57) ABSTRACT

A toner including a toner particle that contains a binder resin and inorganic fine particles, wherein the binder resin contains a polymer A that includes a first monomer unit derived from a first polymerizable monomer and a second monomer unit derived from a second polymerizable monomer that is different from the first polymerizable monomer; the first polymerizable monomer is at least one selected from the group consisting of (meth)acrylate esters having an alkyl group having 18 to 36 carbons; the SP value of the first monomer unit and the SP value of the second monomer unit satisfy a specified relationship; each of the inorganic fine particles contains a substrate containing at least one inorganic element selected from metal elements and metalloid elements, and a coating layer; and the coating layer has a specified structure.

17 Claims, No Drawings

(56) References Cited

U.S. PATENT DOCUMENTS

| | | | | |
|---|---|---|---|---|
| 10,012,919 | B2 | 7/2018 | Matsui et al. | |
| 10,012,923 | B2 | 7/2018 | Sano et al. | |
| 10,101,683 | B2 | 10/2018 | Nishikawa et al. | |
| 10,151,990 | B2 | 12/2018 | Suzuki et al. | |
| 10,156,800 | B2 | 12/2018 | Tsuda et al. | |
| 10,197,934 | B2 | 2/2019 | Matsui et al. | |
| 10,228,627 | B2 | 3/2019 | Nagashima et al. | |
| 10,241,430 | B2 | 3/2019 | Kimura et al. | |
| 10,289,016 | B2 | 5/2019 | Fukudome et al. | |
| 10,295,920 | B2 | 5/2019 | Nishikawa et al. | |
| 10,295,921 | B2 | 5/2019 | Ohmori et al. | |
| 10,303,075 | B2 | 5/2019 | Tanaka et al. | |
| 10,310,397 | B2 | 6/2019 | Sano et al. | |
| 10,545,420 | B2 | 1/2020 | Kinumatsu et al. | |
| 10,578,990 | B2 | 3/2020 | Tsuda et al. | |
| 10,656,545 | B2 | 5/2020 | Kamae et al. | |
| 10,698,327 | B2 | 6/2020 | Nagashima et al. | |
| 10,732,529 | B2 * | 8/2020 | Yoshiba ..... | G03G 9/09741 |
| 2005/0209364 | A1 | 9/2005 | Yamagishi et al. | |
| 2006/0121379 | A1 | 6/2006 | Dojo et al. | |
| 2009/0197192 | A1 | 8/2009 | Hiroko et al. | |
| 2013/0252167 | A1 | 9/2013 | Moribe et al. | |
| 2014/0004460 | A1 | 1/2014 | Yoshiba et al. | |
| 2015/0185658 | A1 | 7/2015 | Wakabayashi et al. | |
| 2015/0220013 | A1 | 8/2015 | Nishikawa et al. | |
| 2016/0139522 | A1 | 5/2016 | Yoshiba et al. | |
| 2016/0161874 | A1 | 6/2016 | Yamazaki et al. | |
| 2016/0378003 | A1 | 12/2016 | Arimura et al. | |
| 2019/0041762 | A1 | 2/2019 | Yoshiba et al. | |
| 2019/0310564 | A1 | 10/2019 | Koshima | |
| 2019/0384192 | A1 | 12/2019 | Kagawa et al. | |
| 2019/0384193 | A1 | 12/2019 | Hashimoto et al. | |
| 2019/0384194 | A1 | 12/2019 | Yoshiba et al. | |
| 2019/0384195 | A1 | 12/2019 | Saeki et al. | |
| 2019/0384197 | A1 | 12/2019 | Aoki et al. | |
| 2019/0384198 | A1 | 12/2019 | Matsui et al. | |
| 2019/0384200 | A1 | 12/2019 | Kamikura et al. | |
| 2019/0384202 | A1 | 12/2019 | Shirayama et al. | |
| 2020/0081361 | A1 | 3/2020 | Yoshiba et al. | |
| 2020/0166861 | A1 | 5/2020 | Uratani et al. | |

OTHER PUBLICATIONS

U.S. Appl. No. 16/819,736, Kazuyuki Soto, filed Mar. 16, 2020.
U.S. Appl. No. 16/868,635, Yuta Komiya, filed May 7, 2020.
U.S. Appl. No. 16/907,814, Takashi Matsui, filed Jun. 22, 2020.
U.S. Appl. No. 16/910,301, Daisuke Yoshiba, filed Jun. 24, 2020.

* cited by examiner

TONER AND METHOD OF PRODUCING TONER

BACKGROUND OF THE INVENTION

Field of the Invention

The present disclosure relates to a toner used in electrophotographic methods, electrostatic recording methods, and toner jet system recording methods, and to a method of producing the toner.

Description of the Related Art

There is increasing demand for greater energy conservation and higher speeds from image-forming devices that use electrophotographic methods. In order to respond to this, there is increasing need for the toner to exhibit an excellent low-temperature fixability, i.e., the ability to undergo fixing with small amounts of heat.

Lowering the glass transition point (Tg) of the binder resin in toner is an example of a method for realizing an excellent low-temperature fixability. However, while toner having a reduced Tg can provide a good fixed image at lower temperatures, it has been difficult for this to coexist with the heat-resistant storability.

Methods that use a crystalline resin as the main binder have thus been investigated in order to bring about coexistence between the low-temperature fixability and the heat-resistant storability. When the viscoelasticity of a crystalline resin is measured by gradually raising the temperature from room temperature during a dynamic viscoelastic measurement, the viscosity undergoes very little change up the melting point, while at the melting point plastification suddenly occurs and a sharp drop in the viscosity also occurs accompanying this. As a consequence, crystalline resins exhibit an excellent sharp melt property and have thus received attention as materials that provide coexistence between the low-temperature fixability and heat-resistant storability.

However, the molecular chains in a crystalline resin are oriented with a certain regularity, and as a consequence crystalline resins exhibit the behavior of readily undergoing brittle cracking. Due to this, toner that contains large amounts of a crystalline resin is not robust to external stresses, e.g., stirring in the developing device, and thus exhibits durability problems.

In addition, in an image-forming device that has been sped up, the printed recording paper is discharged via a short paper path and the toner, which has been melted during passage through the fixing nip, is placed under a substantial load prior to satisfactory solidification. The following problems are generated as a consequence: the problem of adhesion of the loaded recording paper and a failure to release; and the problem of the release of the toner that has undergone one fixing process and its transfer to another sheet of paper. These are known as the problems associated with discharged paper adhesion. These phenomena are readily produced with toner that has been provided with low-temperature fixability in order to accommodate high-speed printing.

A variety of proposals have been made to date with regard to improving the low-temperature fixability, heat-resistant storability, durability, or discharged paper adhesion behavior of toner that uses a crystalline resin as the main binder.

Japanese Patent Application Laid-open No. 2014-130243 proposes a toner that uses the following in the binder resin of a toner core: a crystalline vinyl resin provided by the copolymerization of a long-chain alkyl group-bearing polymerizable monomer and a polymerizable monomer that forms an amorphous segment.

WO 2018/110593 proposes a toner that uses a binder resin from a long-chain alkyl group-bearing polymerizable monomer and a polymerizable monomer that forms an amorphous segment, wherein the difference between the SP values of the polymerizable monomers is controlled into a certain range.

SUMMARY OF THE INVENTION

The binder resin used in the toner described in Japanese Patent Application Laid-open No. 2014-130243 exhibits coexistence between the low-temperature fixability and the heat-resistant storability. However, the binder resin used in this toner has a high content of the structure derived from the long-chain alkyl group-bearing polymerizable monomer and exhibits a low elasticity around room temperature, and due to this the durability readily declines. In addition, there is no mention of the discharged paper adhesion behavior and the discussion on controlling the crystalline state is inadequate, and thus there is room for improvement.

On the other hand, the binder resin used in the toner described in WO 2018/110593 exhibits coexistence at a higher level between the low-temperature fixability and the heat-resistant storability. However, there is no discussion of the discharged paper adhesion behavior or the durability, which are problems for toner that uses a crystalline resin as the binder resin, and there is thus room for improvement.

The present disclosure provides a toner that solves the problems identified above. That is, the present disclosure provides a toner that exhibits an excellent low-temperature fixability, heat-resistant storability, durability, and discharged paper adhesion behavior.

The present disclosure is a toner comprising a toner particle that contains a binder resin and inorganic fine particles, wherein the binder resin contains a polymer A that includes a first monomer unit derived from a first polymerizable monomer, and a second monomer unit derived from a second polymerizable monomer that is different from the first polymerizable monomer;

the first polymerizable monomer is at least one selected from the group consisting of (meth)acrylate esters having an alkyl group having 18 to 36 carbons;

where $SP_{11}$ $(J/cm^3)^{0.5}$ designates an SP value of the first monomer unit and $SP_{21}$ $(J/cm^3)^{0.5}$ designates an SP value of the second monomer unit, the following formula (1) is satisfied:

$$3.00 \leq (SP_{21} - SP_{11}) \leq 25.00 \quad (1);$$

each of the inorganic fine particles contains a substrate containing at least one inorganic element selected from metal elements and metalloid elements, and a coating layer; and the coating layer has a structure represented by at least one selected from the group consisting of the following formulas (A), (B), (C), and (D).

Moreover, the present disclosure is a toner comprising a toner particle that contains a binder resin and inorganic fine particles, wherein the binder resin contains a polymer A that is a polymer of a composition containing a first polymerizable monomer, and a second polymerizable monomer that is different from the first polymerizable monomer;

the first polymerizable monomer is at least one selected from the group consisting of (meth)acrylate esters having an alkyl group having 18 to 36 carbons;

where $SP_{12}$ $(J/cm^3)^{0.5}$ designates an SP value of the first polymerizable monomer and $SP_{22}$ $(J/cm^3)^{0.5}$ designates an SP value of the second polymerizable monomer, the following formula (2) is satisfied:

$$0.60 \leq (SP_{22} - SP_{12}) \leq 15.00 \quad (2),$$

each of the inorganic fine particles contains a substrate containing at least one inorganic element selected from metal elements and metalloid elements, and a coating layer; and the coating layer has a structure represented by at least one selected from the group consisting of the following formulas (A), (B), (C), and (D).

(A)

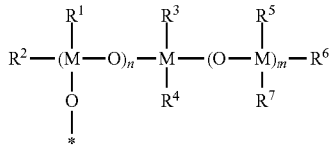

(B)

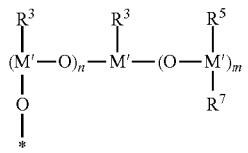

(C)

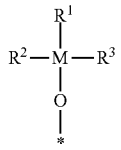

(D)

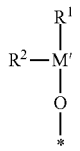

Wherein M each independently represents one or more elements selected from the group consisting of tetravalent Si, tetravalent Ti, and tetravalent Zr; M' each independently represents one or more elements selected from the group consisting of trivalent Ti, trivalent Zr, and trivalent Al; each $R^1$ independently represents an alkyl group or a derivative thereof; $R^2$ to $R^7$ each independently represent a hydrogen atom, hydroxy group, —O—* or a group selected from the group consisting of alkoxy groups, alkyl groups, and derivatives thereof; * represents a bonding segment to the inorganic element; and n and m each independently represent a positive integer equal to or greater than 1.

Further, the present disclosure is a toner comprising a toner particle that contains a binder resin and inorganic fine particles, wherein the binder resin contains a polymer A that includes a first monomer unit derived from a first polymerizable monomer, and a second monomer unit derived from a second polymerizable monomer that is different from the first polymerizable monomer;

the first polymerizable monomer is at least one selected from the group consisting of (meth)acrylate esters having an alkyl group having 18 to 36 carbons;

where $SP_{11}$ $(J/cm^3)^{0.5}$ designates an SP value of the first monomer unit and $SP_{21}$ $(J/cm^3)^{0.5}$ designates an SP value of the second monomer unit, the following formula (1) is satisfied:

$$3.00 \leq (SP_{21} - SP_{11}) \leq 25.00 \quad (1);$$

each of the inorganic fine particles contains a substrate containing at least one inorganic element selected from metal elements and metalloid elements; and the substrate has been treated with a compound that has an alkoxy group and an alkyl group.

Furthermore, the present disclosure is a method of producing the toner according to claim 1, the method comprising:

a step of forming, in an aqueous medium, a particle of a polymerizable monomer composition that contains a polymerizable monomer; and a step of obtaining the toner particle containing a polymer A obtained by polymerizing the polymerizable monomer contained in the particle.

According to the present disclosure, a toner that exhibits an excellent low-temperature fixability, heat-resistant storability, durability, and discharged paper adhesion behavior can be provided.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer in the present disclosure to numerical value ranges that include the lower limit and upper limit that are the end points.

In the present disclosure, "(meth)acrylate ester" means acrylate ester and/or methacrylate ester.

The "monomer unit" in the present disclosure refers to the reacted state of the monomer material in the polymer. For example, one unit is taken to be one carbon-carbon bond segment in a main chain provided by the polymerization of a vinyl monomer into a polymer.

Vinyl monomers can be represented by the following formula (Z):

(Z)

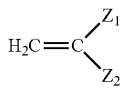

wherein, $Z_1$ represents a hydrogen atom or alkyl group (preferably an alkyl group having 1 to 3 carbons and more preferably the methyl group) and $Z_2$ represents any substituent.

A "crystalline resin" denotes a resin that displays a distinct endothermic peak in measurement by differential scanning calorimetry (DSC).

Crystalline vinyl resins generally have a long-chain alkyl group side chain on the main chain skeleton and exhibit crystallinity as a resin through crystallization between the long-chain alkyl groups in side chain position.

Thus, when a long-chain alkyl group-bearing crystalline vinyl resin is used, a higher content of the long-chain alkyl group results in an increase in the crystallinity and an increase in the melting point, and, accompanying this, in the appearance of a sharp melt property and an excellent low-temperature fixability and an excellent heat-resistant storability.

However, the elasticity of the crystalline vinyl resin around room temperature declines when the long-chain alkyl group content is high. The toner becomes brittle as a result and a decline in the durability then readily occurs.

On the other hand, the crystallinity undergoes an extreme decline and the melting point is reduced when, in order to ameliorate this decline in the durability, the content of the long-chain alkyl group is brought to or below a certain level by carrying out copolymerization between a long-chain alkyl group-bearing polymerizable monomer and another polymerizable monomer. This results in a decline in the heat-resistant storability, a decline in the sharp melt property, and also a decline in the low-temperature fixability.

Moreover, when toner that has a crystalline portion is temporarily melted during the fixing step, a part of the crystalline portion compatibilizes with the amorphous portion and either its crystallinity is never recovered or some time is required for the crystallinity to be recovered. The following problems of discharged paper adhesion (discharged paper adhesion behavior) readily occur when the discharged paper is loaded in this condition: the problem of separate sheets of paper sticking to one another with a failure of release from one another, and the problem of the release of the fixed toner and its transfer to another sheet of paper. As a consequence, coexistence between the low-temperature fixability and the discharged paper adhesion behavior has been a major problem to date.

As a result of intensive investigations, the present inventors discovered that this problem is solved by controlling the type of the long-chain alkyl group-bearing monomer unit and the other monomer unit and the difference in their SP values and by the co-use of inorganic fine particles having a prescribed coating layer.

The present disclosure is a toner comprising a toner particle that contains a binder resin and inorganic fine particles, wherein the binder resin contains a polymer A that includes a first monomer unit derived from a first polymerizable monomer, and a second monomer unit derived from a second polymerizable monomer that is different from the first polymerizable monomer;

the first polymerizable monomer is at least one selected from the group consisting of (meth)acrylate esters having an alkyl group having 18 to 36 carbons;

where $SP_{11}$ $(J/cm^3)^{0.5}$ designates an SP value of the first monomer unit and $SP_{21}$ $(J/cm^3)^{0.5}$ designates an SP value of the second monomer unit, the following formula (1) is satisfied:

$$3.00 \leq (SP_{21} - SP_{11}) \leq 25.00 \quad (1);$$

each of the inorganic fine particles contains a substrate containing at least one inorganic element selected from metal elements and metalloid elements, and a coating layer; and the coating layer has a structure represented by at least one selected from the group consisting of the following formulas (A), (B), (C), and (D).

Moreover, the present disclosure is a toner comprising a toner particle that contains a binder resin and inorganic fine particles, wherein the binder resin contains a polymer A that is a polymer of a composition containing a first polymerizable monomer, and a second polymerizable monomer that is different from the first polymerizable monomer;

the first polymerizable monomer is at least one selected from the group consisting of (meth)acrylate esters having an alkyl group having 18 to 36 carbons;

where $SP_{12}$ $(J/cm^3)^{0.5}$ designates an SP value of the first polymerizable monomer and $SP_{22}$ $(J/cm^3)^{0.5}$ designates an SP value of the second polymerizable monomer, the following formula (2) is satisfied:

$$0.60 \leq (SP_{22} - SP_{12}) \leq 15.00 \quad (2),$$

each of the inorganic fine particles contains a substrate containing at least one inorganic element selected from metal elements and metalloid elements, and a coating layer; and the coating layer has a structure represented by at least one selected from the group consisting of the following formulas (A), (B), (C), and (D).

(A)

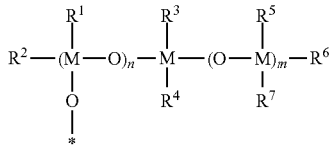

(B)

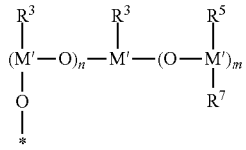

(C)

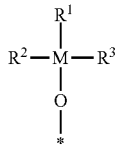

(D)

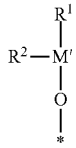

Wherein M each independently represents one or more elements selected from the group consisting of tetravalent Si, tetravalent Ti, and tetravalent Zr; M' each independently represents one or more elements selected from the group consisting of trivalent Ti, trivalent Zr, and trivalent Al; each $R^1$ independently represents an alkyl group or a derivative thereof; $R^2$ to $R^7$ each independently represent a hydrogen atom, hydroxy group, —O—* or a group selected from the group consisting of alkoxy groups, alkyl groups, and derivatives thereof; * represents a bonding segment to the inorganic element; and n and m each independently represent a positive integer equal to or greater than 1.

Further, the present disclosure is a toner comprising a toner particle that contains a binder resin and inorganic fine particles, wherein the binder resin contains a polymer A that includes a first monomer unit derived from a first polymerizable monomer, and a second monomer unit derived from a second polymerizable monomer that is different from the first polymerizable monomer;

the first polymerizable monomer is at least one selected from the group consisting of (meth)acrylate esters having an alkyl group having 18 to 36 carbons;

where $SP_{11}$ $(J/cm^3)^{0.5}$ designates an SP value of the first monomer unit and $SP_{21}$ $(J/cm^3)^{0.5}$ designates an SP value of the second monomer unit, the following formula (1) is satisfied:

$$3.00 \leq (SP_{21} - SP_{11}) \leq 25.00 \quad (1);$$

each of the inorganic fine particles contains a substrate containing at least one inorganic element selected from metal elements and metalloid elements; and the substrate has been treated with a compound that has an alkoxy group and an alkyl group.

The SP value referenced here is an abbreviation for solubility parameter and is a value that acts as an index for solubility. The procedure for its calculation is described below.

The polymer A occurs as a resin that exhibits crystallinity because the first polymerizable monomer is at least one selected from the group consisting of (meth)acrylate esters having an alkyl group having 18 to 36 carbons. The melting point of the polymer A can be controlled into a preferred range (for example, from 50° C. to 80° C.) when the number of carbons is in the indicated range.

Where $SP_{11}$ $(J/cm^3)^{0.5}$ designates the SP value of the first monomer unit and $SP_{21}$ $(J/cm^3)^{0.5}$ designates the SP value of the second monomer unit, the following formula (1) is satisfied.

Where $SP_{12}$ $(J/cm^3)^{0.5}$ designates the SP value of the first polymerizable monomer and $SP_{22}$ $(J/cm^3)^{0.5}$ designates the SP value of the second polymerizable monomer, the following formula (2) is satisfied.

$$3.00 \leq (SP_{21} - SP_{11}) \leq 25.00 \quad (1)$$

$$0.60 \leq (SP_{22} - SP_{12}) \leq 15.00 \quad (2)$$

The value of $(SP_{21}-SP_{11})$ is preferably 4.00 to 20.00 and is more preferably 5.00 to 15.00.

The value of $(SP_{22}-SP_{12})$ is preferably 2.00 to 10.00 and is more preferably 3.00 to 7.00.

The unit for the SP value in the present disclosure is $(J/m^3)^{0.5}$, but this can be converted to the $(cal/cm^3)^{0.5}$ unit using the following formula.

$$1\ (cal/cm^3)^{0.5} = 2.045 \times 10^3\ (J/m^3)^{0.5}$$

By satisfying formula (1) or formula (2), there is no reduction in the crystallinity of the polymer A and its melting point is maintained.

The crystallinity of the polymer A can be controlled at an even higher level by having the toner particle contain, in addition to the polymer A, inorganic fine particles, each of the inorganic fine particles containing a substrate containing a specified inorganic element and a coating layer having a specified structure (that is, the substrate has been treated with a specified compound). Doing this makes it possible for all of the following to coexist: the low-temperature fixability, the heat-resistant storability, the durability, and the discharged paper adhesion behavior.

The reasons for this are hypothesized as follows.

The first monomer unit generates crystallinity through its incorporation in the polymer A and aggregation between/among the first monomer units. However, when another monomer unit is incorporated, as a general matter this other monomer unit will readily interfere with the crystallization of the first monomer unit, resulting in an impaired generation of crystallinity for the polymer. This trend becomes substantial when the first monomer unit and another monomer unit are randomly bonded in the individual polymer molecule.

On the other hand, it is thought that, through the use of polymerizable monomers for which $(SP_{22}-SP_{12})$ resides in the range given by formula (2), during polymerization the first polymerizable monomer and the second polymerizable monomer do not engage in random polymerization and to a certain degree assume a continuous polymerization mode. Due to the presence of the difference in the SP values when $(SP_{22}-SP_{12})$ is in the range of formula (2), it is thought that polymer segments containing the monomer unit derived from the first polymerizable monomer and polymer segments containing the monomer unit derived from the second polymerizable monomer can form a phase-separated state at a microregional level.

It is also thought that, by having $(SP_{21}-SP_{11})$ be in the range of formula (1), the first monomer unit and the second monomer unit in the polymer A are not compatible and can form a distinct phase-separated state.

As a consequence, by having the SP values satisfy formula (1) or (2), it is thought that a polymer segment can then be obtained in which the first polymerizable monomer has undergone continuous polymerization to a certain degree and the crystallinity of the polymer segment can be increased and the melting point is maintained.

That is, the polymer A preferably has a crystalline segment containing the first monomer unit derived from the first polymerizable monomer and a high-polarity segment (or amorphous segment) containing the second monomer unit derived from the second polymerizable monomer.

A high-polarity segment originating with the M-O bond and a low-polarity segment originating with the alkyl group or derivative thereof are present in the coating layer having a structure represented by at least one selected from the group consisting of formulas (A) to (D).

When a polymer A-containing toner particle contains inorganic fine particles having the coating layer as described above, it is thought that the second monomer unit, which is derived from the high-polarity second polymerizable monomer, engages in a dipole-dipole interaction with the high-polarity segment in the coating layer on the inorganic fine particles. It is also thought that an intermolecular force acts between the first monomer unit, which is derived from the low-polarity first polymerizable monomer, and the low-polarity segment in the coating layer on the inorganic fine particles. It is hypothesized that, as a result, the polymer A orients to the inorganic fine particle surface with the first monomer unit as the outside and the second monomer unit as the inside and the crystallinity of the polymer A is further increased and the crystalline state is made uniform.

Accordingly, as compared to the absence of the inorganic fine particles, recrystallization post-fixing is faster and the discharged paper adhesion behavior is improved. In addition, due to the higher crystallinity, the sharp melt property is enhanced and the low-temperature fixability and the heat-resistant storability can coexist at an even higher level. Moreover, because the crystalline state is uniform, stresses applied to the toner, e.g., during stirring in the developer container, are dispersed and the durability is thus enhanced.

When $(SP_{22}-SP_{12})$ is smaller than 0.60 $(J/cm^3)^{0.5}$, the melting point of the polymer A declines and the heat-resistant storability declines. In addition, due to the small magnitude taken on by the dipole-dipole interaction between the high-polarity second monomer unit in the polymer A and the high-polarity segment in the coating layer on the inorganic fine particles, the crystallinity becomes small and the discharged paper adhesion behavior declines.

When, on the other hand, $(SP_{22}-SP_{12})$ is larger than 15.00 $(J/cm^3)^{0.5}$, the copolymerizability of the polymer A is thought to deteriorate and nonuniformity is generated and the low-temperature fixability declines.

Similarly, when $(SP_{21}-SP_{11})$ is smaller than 3.00 $(J/cm^3)^{0.5}$, the melting point of the polymer A declines and the heat-resistant storability declines. In addition, due to the small magnitude taken on by the dipole-dipole interaction between the high-polarity second monomer unit in the polymer A and the high-polarity segment in the coating layer on the inorganic fine particles, the crystallinity becomes small and the discharged paper adhesion behavior declines.

When, on the other hand, $(SP_{21}-SP_{11})$ is larger than 25.00 $(J/cm^3)^{0.5}$, the copolymerizability of the polymer A is thought to deteriorate and nonuniformity is generated and the low-temperature fixability declines.

When the inorganic fine particles lack the prescribed coating layer, that is, when the substrate has not been treated with the prescribed compound, the enhancing effect for the crystallinity of the polymer A is poor and nonuniformity of the polymer A is also produced.

That is, the crystallinity of the polymer A can be controlled and the low-temperature fixability, heat-resistant storability, durability, and discharged paper adhesion behavior can be made to coexist by controlling the type and content of the long-chain alkyl group-bearing monomer unit and the other monomer unit and the difference in their SP values and by the co-use of inorganic fine particles having the prescribed coating layer.

When the polymer A contains a plurality of species of monomer units that satisfy the requirements for the aforementioned first monomer unit, the value provided by the weighted-averaging of the SP values of each of these monomer units is used for the value of $SP_{11}$ in formula (1). For example, the SP value $(SP_{11})$ is expressed by the following formula (6) when a monomer unit A having an SP value of $SP_{111}$ is contained at A mol % with reference to the number of moles of all the monomer units that satisfy the requirements for the first monomer unit and a monomer unit B having an SP value of $SP_{112}$ is contained at (100−A) mol % with reference to the number of moles of all the monomer units that satisfy the requirements for the first monomer unit.

$$SP_{11}=(SP_{111}\times A+SP_{112}\times(100-A))/100 \quad (6)$$

The calculations are similarly performed when three or more monomer units that satisfy the requirements for the first monomer unit are incorporated. $SP_{12}$, on the other hand, also represents the average value similarly calculated using the molar ratios of the respective first polymerizable monomers.

On the other hand, the monomer unit derived from the second polymerizable monomer applies to all monomer units having an $SP_{21}$ that satisfies formula (1) with respect to $SP_{11}$ as calculated by the aforementioned method. Similarly, the second polymerizable monomer applies to all polymerizable monomers having an $SP_{22}$ that satisfies formula (6) with respect to SP 12 as calculated by the aforementioned method.

That is, when the second polymerizable monomer is two or more species of polymerizable monomers, $SP_{21}$ represents the SP value of the monomer unit derived from each polymerizable monomer and $SP_{21}-SP_{11}$ is determined for the monomer unit derived from each second polymerizable monomer. Similarly, $SP_{22}$ represents the SP value of each polymerizable monomer and $SP_{22}-SP_{12}$ is determined for each second polymerizable monomer.

Each of the inorganic fine particles contains a substrate containing at least one inorganic element selected from metal elements and metalloid elements.

The metal elements can be exemplified by K, Mg, Ca, Sr, Ba, Ti, V, Cr, Mn, Fe, Co, Ni, Cu, Zn, Y, Zr, Nb, Mo, Pd, Ag, Cd, Nd, W, Pt, Au, and Al.

The metalloid elements can be exemplified by Si and Ge.

The substrate containing at least one inorganic element selected from the aforementioned metal elements and metalloid elements can be exemplified by silica, diatomaceous earth, alumina, zinc oxide, titania, zirconia, calcium oxide, calcium carbonate, magnesium oxide, iron oxide, copper oxide, kaolin, clay, talc, mica, glass fibers, potassium titanate, calcium titanate, magnesium titanate, barium titanate, carbon black, and other inorganic materials.

Examples are iron oxides such as magnetite, maghemite, ferrite, and iron oxides that contain another metal oxide, and metals such as Fe, Co, and Ni or alloys of these metals with a metal such as Al, Co, Cu, Pb, Mg, Ni, Sn, Zn, Sb, Ca, Mn, Se, and Ti, and mixtures of the preceding. Specific examples are magnetite, iron(III) oxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$), and manganese iron oxide ($MnFe_2O_4$).

Among the preceding, metal oxides and metalloid oxides are more preferred from the standpoints of the strength of reactivity with the surface treatment agent, the uniformity of treatment, and the practicality for toner applications, with magnetite being even more preferred.

The number-average particle diameter of the inorganic fine particles is preferably 0.10 μm to 0.40 μm and is more preferably 0.10 μm to 0.25 μm. When the number-average particle diameter of the inorganic fine particles is 0.10 μm or more, the uniform dispersibility in the toner is enhanced. When the number-average particle diameter of the inorganic fine particles is 0.40 μm or less, a surface area of the inorganic fine particle is enlarged. Thus, a larger nucleating agent effect can be obtained by having the particle diameter of the inorganic fine particles be in the indicated range.

The content of the inorganic fine particles, per 100 mass parts of the binder resin, is preferably from 20 mass parts to 150 mass parts and is more preferably from 50 mass parts to 100 mass parts. By having the content of the inorganic fine particles be in the indicated range, a toner can be obtained in which the characteristics of both the inorganic fine particles and the binder resin are satisfactorily expressed.

Each of the inorganic fine particles also contains a coating layer. The coating layer has a structure represented by at least one selected from the group consisting of the following formulas (A), (B), (C), and (D):

(A)

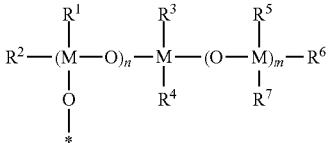

(B)

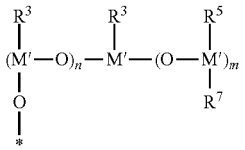

(C)

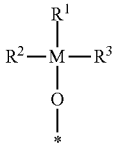

(D)

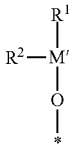

wherein

M each independently represents one or more elements selected from the group consisting of tetravalent Si, tetravalent Ti, and tetravalent Zr;

M' each independently represents one or more elements selected from the group consisting of trivalent Ti, trivalent Zr, and trivalent Al;

$R^1$ each independently represents an alkyl group (preferably having 1 to 20 carbons, more preferably having 4 to 16 carbons, and still more preferably having 4 to 10 carbons) or a derivative thereof;

$R^2$ to $R^7$ each independently represent a hydrogen atom, hydroxy group, —O—* or a group selected from the group consisting of alkoxy groups, alkyl groups (preferably having 1 to 20 carbons, more preferably having 4 to 16 carbons, and still more preferably having 4 to 10 carbons), and derivatives thereof; * represents a bonding segment to the inorganic element; and n and m each independently represent a positive integer equal to or greater than 1.

The alkyl group derivatives that can be represented by $R^1$ to $R^7$ can be specifically exemplified by the butylcyclopentyl group, butylcyclohexyl group, hexylcyclopentyl group, and hexylcyclohexyl group.

The alkoxy group derivatives that can be represented by $R^2$ to $R^7$ can be specifically exemplified by the dicyclopentylmethoxy group, dicyclohexylmethoxy group, tricyclopentylmethoxy group, tricyclohexylmethoxy group, phenylmethoxy group, diphenylmethoxy group, and triphenylmethoxy group.

In order to obtain the structures indicated above, preferably the substrate is treated with a compound that has an alkoxy group and an alkyl group (also referred to herebelow as the surface treatment agent). That is, the inorganic fine particles are preferably the reaction product of a substrate and the surface treatment agent.

Specifically, the substrate is preferably treated with a compound such as, e.g., a silane compound, titanate compound, aluminate compound, zirconate compound, and so forth. That is, the inorganic fine particles are preferably the reaction product of the substrate and a compound such as, e.g., a silane compound, titanate compound, aluminate compound, zirconate compound, and so forth.

All of these surface treatment agents form strong chemical bonds by undergoing hydrolysis and a condensation reaction with the hydroxyl groups present on the surface of the inorganic fine particles. Due—in the case of a toner that contains the inorganic fine particles and the polymer A—to the presence of a structure as described above in the coating layer of the inorganic fine particles, dipole-dipole interactions occur between the second monomer unit, which is derived from the high-polarity second polymerizable monomer, and the high-polarity segment in the coating layer on the inorganic fine particles. In addition, an intermolecular force acts between the first monomer unit, which is derived from the low-polarity first polymerizable monomer, and the low-polarity segment in the coating layer on the inorganic fine particles. As a result, the polymer A orients to the inorganic fine particle surface with the first monomer unit as the outside and the second monomer unit as the inside, and the crystallinity of the polymer A is further increased and the crystalline state is made uniform.

The silane compound can be exemplified by methyltrimethoxysilane, ethyltrimethoxysilane, dimethyldimethoxysilane, methyltriethoxysilane, dimethyldiethoxysilane, n-butyltrimethoxysilane, n-dibutyldimethoxysilane, n-butyltriethoxysilane, n-dibutyldiethoxysilane, isobutyltrimethoxysilane, trimethylmethoxysilane, n-hexyltrimethoxysilane, n-octyltrimethoxysilane, n-octyltriethoxysilane, n-decyltrimethoxysilane, n-didecyldimethoxysilane, n-decyltriethoxysilane, n-didecyldiethoxysilane, n-hexadecyltrimethoxysilane, n-hexadecyltriethoxysilane, and n-octadecyltrimethoxysilane, and hydroxylates of the preceding.

The titanate compound can be exemplified by methyltrimethoxytitanium, dimethyldimethoxytitanium, methyltriethoxytitanium, dimethyldiethoxytitanium, n-butyltrimethoxytitanium, n-dibutyldimethoxytitanium, n-butyltriethoxytitanium, n-dibutyldiethoxytitanium, isobutyltrimethoxytitanium, trimethylmethoxytitanium, n-hexyltrimethoxytitanium, n-octyltrimethoxytitanium, n-octyltriethoxytitanium, n-decyltrimethoxytitanium, n-didecyldimethoxytitanium, n-decyltriethoxytitanium, n-didecyldiethoxytitanium, n-hexadecyltrimethoxytitanium, n-hexadecyltriethoxytitanium, and n-octadecyltrimethoxytitanium, and hydroxylates of the preceding.

The aluminate compound can be exemplified by methyldimethoxyaluminum, dimethylmethoxyaluminum, methyldiethoxyaluminum, dimethylethoxyaluminum, ethyldimethoxyaluminum, ethyldiethoxyaluminum, n-propyldimethoxyaluminum, n-propyldiethoxyaluminum, n-butyldimethoxyaluminum, n-butyldiethoxyaluminum, n-dibutylmethoxyaluminum, n-butyldiethoxyaluminum, n-dibutylethoxyaluminum, isobutyldimethoxyaluminum, n-pentyldimethoxyaluminum, n-pentyldiethoxyaluminum, hexyldimethoxyaluminum, hexyldiethoxyaluminum, octyldimethoxyaluminum, octyldiethoxyaluminum, n-decyldimethoxyaluminum, n-didecylmethoxyaluminum, n-decyldiethoxyaluminum, n-didecylethoxyaluminum, n-hexadecyldimethoxyaluminum, n-hexadecyldiethoxyaluminum, and n-octadecyldimethoxyaluminum, and hydroxylates of the preceding.

The zirconate compound can be exemplified by methyltrimethoxyzirconium, dimethyldimethoxyzirconium, methyltriethoxyzirconium, dimethyldiethoxyzirconium, n-butyltrimethoxyzirconium, n-dibutyldimethoxyzirconium, n-butyltriethoxyzirconium, n-dibutyldiethoxyzirconium, isobutyltrimethoxyzirconium, trimethylmethoxyzirconium, n-hexyltrimethoxyzirconium, n-octyltrimethoxyzirconium, n-octyltriethoxyzirconium, n-decyltrimethoxyzirconium, n-didecyldimethoxyzirconium, n-decyltriethoxyzirconium, n-didecyldiethoxyzirconium, n-hexadecyltrimethoxyzirconium, n-hexadecyltriethoxyzirconium, and n-octadecyltrimethoxyzirconium, and hydroxylates of the preceding.

A single one of the aforementioned silane compounds, titanate compounds, aluminate compounds, and zirconate compounds may be used by itself, or a plurality may be used in combination. When a plurality are used in combination, a separate treatment may be performed with each compound, or a simultaneous treatment may be carried out.

The amount of use of the surface treatment agent is not particularly limited and can be adjusted as appropriate within a range in which the effects of the present disclosure are not impaired.

The surface treatment agent may also be a surface treatment agent on which a hydrolysis treatment has been performed. Due to the execution of a hydrolysis treatment, adsorption occurs via hydrogen bonding with, e.g., the hydroxyl groups present on the inorganic fine particle surface, and heating and dehydration can then lead to the formation of strong chemical bonds. In addition, volatilization of the compound during heating can be suppressed through the formation of hydrogen bonds. Due to the occurrence of the chemical bonding, the treatment agent then does not detach from the inorganic fine particles during the toner production process and thus can be used without affecting the stability of toner production. Moreover, the low-temperature fixability and durability are improved because a high orientability is provided for the first monomer unit at the inorganic fine particle surface.

The amount of the surface treatment agent present on the inorganic fine particle surface can be determined by measuring the amount of carbon contained by the substrate, i.e., the inorganic fine particles, after treatment. The amount of carbon contained by the inorganic fine particles, expressed with reference to the inorganic fine particles, is preferably 0.30 mass % to 2.50 mass % and is more preferably 0.30 mass % to 2.00 mass %. Within this range, the surface treatment agent can be used without affecting the stability of toner production.

Among the preceding, compounds having the structure given by the following formula (3) are preferably used as the surface treatment agent. That is, the substrate has preferably been treated with a compound represented by the following formula (3). In other words, the inorganic fine particles are preferably the reaction product of the substrate and a compound represented by the following formula (3):

$$R'_m SiY'_n \quad (3)$$

wherein R' represents an alkoxy group; m represents an integer of 1 to 3; Y' represents an alkyl group or a derivative thereof; and n represents an integer of 1 to 3; provided that m+n=4.

The number of carbons in the alkyl group encompassed by Y' is preferably 1 to 20 carbons, more preferably 4 to 16 carbons, and still more preferably 4 to 10 carbons. It is thought that, by having the number of carbons in the alkyl group be in the indicated range, a large interaction is then established between the alkyl group in the surface treatment agent and the monomer unit derived from the first polymerizable monomer and the crystallinity of the polymer A is further increased. The heat-resistant storability and discharged paper adhesion behavior can be further enhanced as a consequence.

The alkyl group derivatives that can be represented by Y' can be specifically exemplified by the butylcyclopentyl group, butylcyclohexyl group, hexylcyclopentyl group, and hexylcyclohexyl group.

By having the surface treatment agent have the structure with formula (3), through control of the hydrolysis conditions self-condensation can be suppressed while also increasing the percentage hydrolysis, and a more uniform treatment of the inorganic fine particle surface can be achieved as a consequence. As a result, a uniform interaction occurs between the first monomer unit and the coating layer-bearing inorganic fine particles and a high crystallinity is achieved, a uniform crystalline state is established, and the discharged paper adhesion behavior and durability are further improved.

Methods for treating a metal oxide, e.g., magnetite, with a silane compound are provided below as examples. The following methods are examples and there is no limitation to or by these.

When the surface treatment is carried out by a wet method, a dispersion of the metal oxide dispersed in an aqueous medium is prepared. The pH of the obtained redispersion is adjusted to from 3.0 to 6.5; the alkoxysilane is gradually introduced; and dispersion to uniformity is carried out using, for example, a dispersing impeller. The liquid temperature of the dispersion at this time is preferably from 35° C. to 60° C. In general, hydrolysis of the alkoxysilane is facilitated at lower pH values and higher liquid temperatures.

Treatment using the silane compound may also be performed in the vapor phase. In a specific treatment method here, the silane compound is added by spraying while the untreated metal oxide is stirred with a Henschel mixer. This is followed by heating to a temperature at which the condensation reaction can proceed and then standing at quiescence and developing the condensation reaction of the silane compound while drying the metal oxide.

Fine particles having the silane compound chemically bonded to the metal oxide surface can be obtained using the methods described in the preceding.

It is also preferable that in the moisture adsorption/desorption curves for the inorganic fine particles, the following formulas (4) and (5) are satisfied:

$$1.5 \leq Z \leq 10.0 \quad (4)$$

$$Y - X \geq 0.10 \quad (5)$$

wherein X is an amount of moisture adsorption (mg/g) for the adsorption curve at 30.0° C. and 10% relative humidity, Y is an amount of moisture adsorption (mg/g) for the desorption curve at 30.0° C. and 10% relative humidity, and Z is an amount of moisture adsorption (mg/g) at 30.0° C. and 100% relative humidity.

By having Z in formula (4) be at least 1.5, even in a low-temperature, low-humidity environment the inorganic fine particles will adsorb an amount of moisture within a certain range, toner charge up can be suppressed, and the image quality can be further enhanced.

In addition, by having Z be not more than 10.0, the inorganic fine particles in the vicinity of the toner surface layer will not engage in excessive moisture adsorption in a high-temperature, high-humidity environment and an excessive decline in the charge can be suppressed. The image quality in high-temperature, high-humidity environments can be improved as a result.

Z is more preferably 1.8 to 8.0 and is still more preferably 2.0 to 6.0.

By having Y−X satisfy formula (5), even in a low-temperature, low-humidity environment the inorganic fine particles in the toner surface layer can retain an appropriate amount of moisture and toner charge up can be suppressed. The image quality in low-temperature, low-humidity environments can be improved as a result. Y−X is more preferably at least 0.12 and is still more preferably at least 0.20.

The upper limit on Y−X is not particularly limited, but is preferably not more than 4.00, more preferably not more than 3.00, still more preferably not more than 2.00, and even more preferably not more than 0.40. Any combination may be used for the numerical value range for Y−X.

The method of producing inorganic fine particles that satisfy formula (4) and formula (5) is not particularly limited, but production may be carried out using, for example, the following production method.

The surface treatment can be carried out by a dry method using a wheel kneader or a mortar, for the purpose of causing the expression of a high hydrophobicity by uniformly reacting the surface treatment agent with the substrate particle surface, while at the same time causing an incomplete hydrophobing of the hydroxyl groups on the substrate particle surface in order to leave a portion thereof extant.

For example, a Mix Muller, Multimul, Stotz mill, back-flow kneader, or Eirich mill can be used as the wheel kneader, and the use of a Mix Muller is preferred.

Three actions, i.e., a compressive action, a shearing action, and a spatulation action, can be expressed when a wheel kneader or mortar is used.

The surface treatment agent present between substrate particles is pressed into the substrate surface through the compressive action and the adhesiveness and reactivity with the particle surface can then be increased. Shear force is applied to both the surface treatment agent and substrate through the shearing action and the surface treatment agent can then be smeared out and the substrate particles can be dispersed and disaggregated. Moreover, through the spatulation action, the surface treatment agent present on the substrate surface can be uniformly spread out as if spread with a spatula.

Through the continuous and repeated application of these three actions, the substrate is disaggregated and reaggregation is prevented, and the surface of individual particles can be surface-treated without bias while disaggregating into individual particles.

A stable treatment can be carried out by performing treatment using this method.

When the substrate is treated with the surface treatment agent using a wheel kneader or a mortar, a condition can be formed on the substrate particle surface in which a hydroxyl value that remains unreacted and portions that have reacted with the surface treatment agent are both present in alternation.

By establishing such a condition on the particle surface of the inorganic fine particles, a certain moisture adsorptivity can be provided while raising the hydrophobicity, and the Z value can be brought into the proper range and a large Y−X value can be established.

The toner particle contains a binder resin.

The binder resin contains a polymer A that includes a first monomer unit derived from a first polymerizable monomer and a second monomer unit derived from a second polymerizable monomer that is different from the first polymerizable monomer.

In addition, the binder resin contains a polymer A that is a polymer of a composition containing a first polymerizable monomer and a second polymerizable monomer that is different from the first polymerizable monomer.

The content of the first monomer unit in the polymer A, with reference to the total number of moles of all the monomer units in the polymer A, is preferably 5.00 mol % to 60.00 mol %, more preferably 10.00 mol % to 60.00 mol %, and still more preferably 20.00 mol % to 40.00 mol %.

The content of the first polymerizable monomer in the composition containing the first polymerizable monomer and the second polymerizable monomer, expressed with reference to the total number of moles of all the polymerizable monomer in the composition, is preferably 5.00 mol % to 60.00 mol %, more preferably 10.00 mol % to 60.00 mol %, and still more preferably 20.00 mol % to 40.00 mol %.

The content of the second monomer unit in the polymer A, with reference to the total number of moles of all the monomer units in the polymer A, is preferably 20.00 mol % to 95.00 mol %, more preferably 40.00 mol % to 95.00 mol %, and still more preferably 40.00 mol % to 70.00 mol %.

The content of the second polymerizable monomer in the composition, expressed with reference to the total number of moles of all the polymerizable monomer in the composition, is preferably 20.00 mol % to 95.00 mol %, more preferably 40.00 mol % to 95.00 mol %, and still more preferably 40.00 mol % to 70.00 mol %.

Through the interaction between the polymer A and the inorganic fine particles, a higher crystallinity than heretofore is obtained for toner that contains the coating layer-bearing inorganic fine particles and that has a content of first monomer unit in the polymer A and a content of first polymerizable monomer in the composition in the aforementioned ranges. As a result, the sharp melt property and elasticity of the toner are improved and an excellent low-temperature fixability, durability, heat-resistant storability, and discharged paper adhesion behavior are established.

When the content of the second monomer unit in the polymer A and the content of the second polymerizable monomer in the composition are in the aforementioned ranges, the polymer A can exhibit an improved elasticity at around room temperature while retaining a sharp melt property, and a toner having an excellent low-temperature fixability and an excellent durability is then provided. In addition, the inhibition of the crystallization of the first monomer unit in the polymer A is suppressed and the melting point can also be maintained. A satisfactory interaction between the second monomer unit and the high-polarity segment of the inorganic fine particle surface is also obtained and a good discharged paper adhesion behavior is obtained.

The first polymerizable monomer is at least one selected from the group consisting of (meth)acrylate esters having an alkyl group having 18 to 36 carbons.

The (meth)acrylate esters having an alkyl group having 18 to 36 carbons can be exemplified by (meth)acrylate esters having a linear alkyl group having 18 to 36 carbons [e.g., stearyl (meth)acrylate, nonadecyl (meth)acrylate, eicosyl (meth)acrylate, heneicosyl (meth)acrylate, behenyl (meth) acrylate, lignoceryl (meth)acrylate, ceryl (meth)acrylate, octacosyl (meth)acrylate, myricyl (meth)acrylate, and dotriacontanyl (meth)acrylate] and by (meth)acrylate esters having a branched alkyl group having 18 to 36 carbons [e.g., 2-decyltetradecyl (meth)acrylate].

Among the preceding, at least one selected from the group consisting of (meth)acrylate esters having a linear alkyl group having 18 to 36 carbons is preferred from the standpoint of the heat-resistant storability of the toner. At least one selected from the group consisting of (meth)acrylate esters having a linear alkyl group having 18 to 30 carbons is more preferred. At least one selected from the group consisting of linear stearyl (meth)acrylate and behenyl (meth) acrylate is still more preferred.

A single first polymerizable monomer may be used by itself or two or more may be used in combination.

The second polymerizable monomer can be exemplified by those polymerizable monomers, among the polymerizable monomers provided below, that satisfy formula (1) or formula (2). The second polymerizable monomer preferably has an ethylenically unsaturated bond and more preferably has one ethylenically unsaturated bond. A single second polymerizable monomer may be used by itself or two or more may be used in combination.

Nitrile group-bearing monomers can be exemplified by acrylonitrile and methacrylonitrile.

Examples of hydroxy group-bearing monomers are 2-hydroxyethyl (meth)acrylate and 2-hydroxypropyl (meth)acrylate.

Examples of amide group-bearing monomers are acrylamide and monomers provided by reaction by a known method between an amine having 1 to 30 carbons and a carboxylic acid having 2 to 30 carbons and containing an ethylenically unsaturated bond (e.g., acrylic acid, methacrylic acid).

Urethane group-bearing monomers can be exemplified by monomers provided by the reaction by a known method of an alcohol having 2 to 22 carbons and an ethylenically unsaturated bond (e.g., 2-hydroxyethyl methacrylate and vinyl alcohol) with an isocyanate having 1 to 30 carbons [e.g., monoisocyanate compounds (e.g., benzenesulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethylphenyl isocyanate, 3,5-dimethylphenyl isocyanate, and 2,6-dipropylphenyl isocyanate), aliphatic diisocyanate compounds (e.g., trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate, and 2,4,4-trimethylhexamethylene diisocyanate), alicyclic diisocyanate compounds (e.g., 1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate, and hydrogenated tetramethylxylylene diisocyanate), and aromatic diisocyanate compounds (e.g., phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenyl ether diisocyanate, 4,4'-diphenyl diisocyanate, 1,5-naphthalene diisocyanate, and xylylene diisocyanate)], and by monomers provided by the reaction by a known method between an alcohol having 1 to 26 carbons (e.g., methanol, ethanol, propanol, isopropyl alcohol, butanol, t-butyl alcohol, pentanol, heptanol, octanol, 2-ethylhexanol, nonanol, decanol, undecyl alcohol, lauryl alcohol, dodecyl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol, erucyl alcohol) and an isocyanate having 2 to 30 carbons and containing an ethylenically unsaturated bond [e.g., 2-isocyanatoethyl (meth)acrylate, 2-(O-[1'-methylpropylideneamino]carboxyamino)ethyl (meth)acrylate, 2-[(3,5-dimethylpyrazolyl)carbonylamino]ethyl (meth)acrylate, and 1,1-(bis(meth)acryloyloxymethyl)ethyl isocyanate].

Examples of urea group-bearing monomers are monomers provided by the reaction by a known method of an amine having 3 to 22 carbons [e.g., primary amines (normal-butylamine, t-butylamine, propylamine, and isopropylamine), secondary amines (e.g., di-normal-ethylamine, di-normal-propylamine, and di-normal-butylamine), aniline, and cyclohexylamine] with an isocyanate having 2 to 30 carbons and an ethylenically unsaturated bond.

Examples of carboxy group-bearing monomers are methacrylic acid, acrylic acid, and 2-carboxyethyl (meth)acrylate.

Among the preceding, the use of monomer bearing a nitrile group, amide group, urethane group, hydroxy group, or urea group is preferred. The second polymerizable monomer is more preferably a monomer that has an ethylenically unsaturated bond and at least one functional group selected from the group consisting of the nitrile group, amide group, hydroxy group, urethane group, and urea group.

The presence of these facilitates a high melting point for the polymer A and facilitates an improved heat-resistant storability. In addition, the elasticity around room temperature is increased and improvement in the durability is facilitated.

A vinyl ester, e.g., vinyl acetate, vinyl propionate, vinyl butyrate, vinyl caproate, vinyl caprylate, vinyl caprate, vinyl laurate, vinyl myristate, vinyl palmitate, vinyl stearate, vinyl pivalate, and vinyl octanoate, is also preferably used for the second polymerizable monomer. Vinyl esters are nonconjugated monomers, and the reactivity with the first polymerizable monomer is readily appropriately maintained. It is thought that as a consequence the formation is facilitated of a condition in which monomer units derived from the first polymerizable monomer are bonded in aggregate in the polymer A and the crystallinity of the polymer A is increased and the coexistence of the low-temperature fixability and heat-resistant storability is further facilitated.

In addition, the second polymerizable monomer is preferably at least one selected from the group consisting of the following formulas (E) and (F):

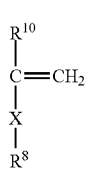

(E)

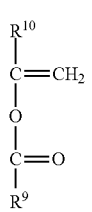

(F)

in formula (E), X represents a single bond or an alkylene group having 1 to 6 carbons;

$R^8$ represents a nitrile group (—C≡N), amide group (—C(=O)NHR$^{11}$, wherein $R^{11}$ is a hydrogen atom or an alkyl group having 1 to 4 carbons), hydroxy group, —COOR$^{12}$, wherein $R^{12}$ is an alkyl group having 1 to 6 (preferably 1 to 4) carbons or a hydroxyalkyl group having 1 to 6 (preferably 1 to 4) carbons, urethane group (—NHCOOR$^{13}$, wherein $R^{13}$ is an alkyl group having 1 to 4 carbons, urea group (—NH—C(=O)—N($R^{14}$)$_2$, wherein each $R^{14}$ is independently a hydrogen atom or an alkyl group having 1 to 6 (preferably 1 to 4) carbons), —COO($CH_2$)$_2$NHCOOR$^{15}$, wherein $R^{15}$ is an alkyl group having 1 to 4 carbons, or —COO($CH_2$)$_2$—NH—C(=O)—N($R^{16}$)$_2$, wherein each $R^{16}$ is independently a hydrogen atom or an alkyl group having 1 to 6 (preferably 1 to 4) carbons; and $R^{10}$ represents a hydrogen atom or methyl group, and in formula (F), $R^9$ represents an alkyl group having 1 to 4 carbons and $R^{10}$ represents a hydrogen atom or a methyl group.

In addition, the second polymerizable monomer is preferably at least one selected from the group consisting of the following formulas (E) and (F):

(E)

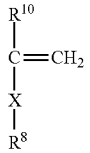

(F)

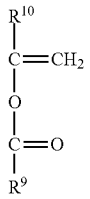

in formula (E), X represents a single bond or an alkylene group having 1 to 6 carbons;

$R^8$ represents a nitrile group (—C≡N), amide group (—C(=O)NHR$^{11}$, wherein $R^{11}$ is a hydrogen atom or an alkyl group having 1 to 4 carbons), hydroxy group, —COOR$^{12}$, wherein $R^{12}$ is an alkyl group having 1 to 6 (preferably 1 to 4) carbons or a hydroxyalkyl group having 1 to 6 (preferably 1 to 4) carbons, urea group (—NH—C(=O)—N($R^{14}$)$_2$, wherein each $R^{14}$ is independently a hydrogen atom or an alkyl group having 1 to 6 carbons), —COO($CH_2$)$_2$NHCOOR$^{15}$, wherein $R^{15}$ is an alkyl group having 1 to 4 carbons, or —COO($CH_2$)$_2$—NH—C(=O)—N($R^{16}$)$_2$, wherein each $R^{16}$ is independently a hydrogen atom or an alkyl group having 1 to 6 (preferably 1 to 4) carbons; and $R^{10}$ represents a hydrogen atom or methyl group, and in formula (F), $R^9$ represents an alkyl group having 1 to 4 carbons and $R^{10}$ represents a hydrogen atom or a methyl group.

The polymer A is preferably a vinyl polymer. Vinyl polymers can be exemplified by polymers from monomers that contain an ethylenically unsaturated bond. The ethylenically unsaturated bond denotes a carbon-carbon double bond capable of undergoing radical polymerization and can be exemplified by the vinyl group, propenyl group, acryloyl group, and methacryloyl group.

The polymer A may contain, within a range that preserves the aforementioned molar ratios for the first monomer unit derived from the first polymerizable monomer and the second monomer unit derived from the second polymerizable monomer, a third monomer unit derived from a third polymerizable monomer that is different from the first polymerizable monomer and different from the second polymerizable monomer.

In addition, the composition containing the first polymerizable monomer and the second polymerizable monomer different from the first polymerizable monomer, may contain, within a range that preserves the contents in the composition of the first polymerizable monomer and the second polymerizable monomer, a third polymerizable monomer different from the first polymerizable monomer and different from the second polymerizable monomer.

In these cases, where $SP_{31}$ $(J/cm^3)^{0.5}$ designates the SP value of the third monomer unit derived from the third polymerizable monomer, the relationship in the following formula (7) is preferably satisfied:

$$0.00<(SP_{31}-SP_{11})<3.00 \quad (7).$$

In addition, where $SP_{32}$ $(J/cm^3)^{0.5}$ designates the SP value of the third polymerizable monomer, the relationship in the following formula (8) is preferably satisfied:

$$0.00<(SP_{32}-SP_{12})<0.60 \quad (8).$$

Those monomers, among the monomers provided above as examples of the second polymerizable monomer, that satisfy formula (7) or formula (8) may be used as the third polymerizable monomer.

The monomer unit derived from the third polymerizable monomer applies to all monomer units having an $SP_{31}$ that satisfies formula (7) with respect to $SP_{11}$. Similarly, the third polymerizable monomer applies to all polymerizable monomers having an $SP_{32}$ that satisfies formula (8) with respect to $SP_{12}$.

That is, when the third polymerizable monomer is two or more species of polymerizable monomers, $SP_{31}$ represents the SP value of the monomer unit derived from each polymerizable monomer and $SP_{31}$–$SP_{11}$ is determined for the monomer unit derived from each third polymerizable monomer. Similarly, $SP_{32}$ represents the SP value of each polymerizable monomer and $SP_{32}$–$SP_{12}$ is determined for each third polymerizable monomer.

The following, for example, can be used as the third polymerizable monomer:

styrene and derivatives thereof, e.g., styrene and o-methylstyrene, and (meth)acrylate esters such as n-butyl (meth) acrylate, t-butyl (meth)acrylate, and 2-ethylhexyl (meth) acrylate.

Styrene, methyl methacrylate, and methyl acrylate are preferred among the aforementioned third polymerizable monomers. Their use facilitates improvements in the durability.

These monomers do not contain a polar group and thus have low SP values, making it difficult for them to satisfy formula (1) or formula (2). However, when they do satisfy formula (1) or formula (2), they can be used as the second polymerizable monomer.

A charge control agent may be used in the toner particle in order to maintain a stable charging performance for the toner regardless of the environment.

Negative-charging charge control agents can be exemplified by monoazo metal compounds; acetylacetone-metal compounds; metal compounds of aromatic oxycarboxylic acids, aromatic dicarboxylic acids, oxycarboxylic acids, and dicarboxylic acids; aromatic oxycarboxylic acids, aromatic monocarboxylic acids, and aromatic polycarboxylic acids and their metal salts, anhydrides, and esters; phenol derivatives such as bisphenol; urea derivatives; metal-containing salicylic acid compounds; metal-containing naphthoic acid compounds; boron compounds; quaternary ammonium salts; calixarene; and resin-type charge control agents.

Positive-charging charge control agents can be exemplified by nigrosine and modifications of nigrosine by, e.g., fatty acid metal salts; guanidine compounds; imidazole compounds; quaternary ammonium salts such as the tributylbenzylammonium salt of 1-hydroxy-4-naphthosulfonic acid and tetrabutylammonium tetrafluoroborate, and their onium salt analogues, e.g., phosphonium salts, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; and resin-type charge control agents.

The content of the charge control agent, per 100 mass parts of the binder resin, is preferably 0.01 mass parts to 10 mass parts and more preferably 0.03 to 8 mass parts. A single one of these charge control agents may be used by itself or two or more may be used in combination.

The toner particle may contain a release agent.

The release agent can be exemplified by the following: waxes in which the main component is a fatty acid ester, e.g., carnauba wax and montanic acid ester wax; waxes provided by the partial or complete deacidification of the acid component from a fatty acid ester, e.g., deacidified carnauba wax; hydroxyl group-containing methyl ester compounds obtained by, e.g., the hydrogenation of plant oils; saturated fatty acid monoesters, e.g., stearyl stearate and behenyl behenate; diesters between a saturated aliphatic dicarboxylic acid and a saturated aliphatic alcohol, e.g., dibehenyl sebacate, distearyl dodecanedioate, and distearyl octadecanedioate; diesters between a saturated aliphatic diol and a saturated fatty acid, e.g., nonanediol dibehenate and dodecanediol distearate; aliphatic hydrocarbon waxes such as low molecular weight polyethylene, low molecular weight polypropylene, microcrystalline wax, paraffin wax, and Fischer-Tropsch wax; the oxides of aliphatic hydrocarbon waxes, e.g., oxidized polyethylene wax, and their block copolymers; waxes provided by grafting an aliphatic hydrocarbon wax using a vinyl monomer such as styrene or acrylic acid; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; and long-chain alkyl alcohols or long-chain alkylcarboxylic acids having at least 12 carbons.

The content of the release agent in the toner particle is preferably 1.0 mass % to 30.0 mass % and is more preferably 2.0 mass % to 25.0 mass %.

The weight-average molecular weight (Mw) of the tetrahydrofuran (THF)-soluble matter of the polymer A, as measured by gel permeation chromatography (GPC), is preferably 10,000 to 200,000 and more preferably 20,000 to 150,000.

Maintenance of the elasticity at around room temperature is facilitated by having the weight-average molecular weight (Mw) be in the indicated range. In addition, the melting point of the polymer A is preferably 50° C. to 80° C. and is more preferably 53° C. to 70° C. Additional improvements in the low-temperature fixability and heat-resistant storability are obtained by having the melting point be in the indicated range.

The melting point of the polymer A can be adjusted through, for example, the type and amount of the first polymerizable monomer that is used and the type and amount of the second polymerizable monomer that is used.

The content of the polymer A in the binder resin is preferably at least 50.0 mass % and is more preferably 80.0 mass % to 100.0 mass %. Even more preferably the binder resin is the polymer A. Retention of the sharp melt property by the toner is facilitated and the low-temperature fixability is enhanced by having the polymer A content in the binder resin be in the indicated range.

Resins that may be used for the binder resin in addition to the polymer A can be exemplified by the heretofore known vinyl resins, polyester resins, polyurethane resins, epoxy resins, and so forth. Vinyl resins, polyester resins, and polyurethane resins are preferred thereamong from the standpoint of the electrophotographic characteristics.

The polymerizable monomers that can be used for the vinyl resins can be exemplified by the polymerizable monomers that can be used for the above-described first polymerizable monomer, second polymerizable monomer, and third polymerizable monomer. A combination of two or more species may be used on an optional basis.

The polyester resin can be obtained by the reaction of an at least dibasic polybasic carboxylic acid with a polyhydric alcohol.

The following compounds are examples of polybasic carboxylic acids: dibasic acids such as succinic acid, adipic acid, sebacic acid, phthalic acid, isophthalic acid, terephthalic acid, malonic acid, and dodecenylsuccinic acid, and their anhydrides and lower alkyl esters; aliphatic unsaturated dicarboxylic acids such as maleic acid, fumaric acid, itaconic acid, and citraconic acid; as well as 1,2,4-benzenetricarboxylic acid and 1,2,5-benzenetricarboxylic acid and their anhydrides and lower alkyl esters. A single one of these may be used by itself or two or more may be used in combination.

The polyhydric alcohol can be exemplified by the following compounds: alkylene glycols (ethylene glycol, 1,2-propylene glycol, and 1,3-propylene glycol), alkylene ether glycols (polyethylene glycol and polypropylene glycol), alicyclic diols (1,4-cyclohexanedimethanol), bisphenols (bisphenol A), and alkylene oxide (ethylene oxide and propylene oxide) adducts on alicyclic diols. The alkyl moieties in the alkylene glycols and alkylene ether glycols may be straight chain or branched chain. Additional examples are glycerol, trimethylolethane, trimethylolpropane, and pentaerythritol. A single one of these may be used by itself or two or more may be used in combination.

As necessary, a monobasic acid such as acetic acid or benzoic acid and a monohydric alcohol such as cyclohexanol or benzyl alcohol may also be used for the purpose of adjusting the acid value or hydroxyl value.

There are no particular limitations on the method of producing the polyester resin, but, for example, a transesterification method or direct polycondensation method, as such or in combination, may be used.

The polyurethane resin is considered in the following. The polyurethane resin is the reaction product of a diol with a substance that contains the diisocyanate group, and resins having various functionalities can be obtained by adjusting the diol and diisocyanate.

The diisocyanate component can be exemplified by the following: aromatic diisocyanates having from 6 to 20 carbons (excluding the carbon in the NCO group, the same applies in the following), aliphatic diisocyanates having from 2 to 18 carbons, and alicyclic diisocyanates having from 4 to 15 carbons, as well as modifications of these diisocyanates (modifications that contain the urethane group, carbodiimide group, allophanate group, urea group, biuret group, uretdione group, uretoimine group, isocyanurate group, or oxazolidone group, also referred to herebelow as "modified diisocyanate") and mixtures of two or more of the preceding.

The following are examples of the aromatic diisocyanates: m- and/or p-xylylene diisocyanate (XDI) and $\alpha,\alpha,\alpha',\alpha'$-tetramethylxylylene diisocyanate.

The following are examples of the aliphatic diisocyanates: ethylene diisocyanate, tetramethylene diisocyanate, hexamethylene diisocyanate (HDI), and dodecamethylene diisocyanate.

The following are examples of alicyclic diisocyanates: isophorone diisocyanate (IPDI), dicyclohexylmethane-4,4'-diisocyanate, cyclohexylene diisocyanate, and methylcyclohexylene diisocyanate.

Preferred among the preceding are aromatic diisocyanates having from 6 to 15 carbons, aliphatic diisocyanates having from 4 to 12 carbons, and alicyclic diisocyanates having from 4 to 15 carbons, wherein XDI, IPDI, and HDI are particularly preferred. A trifunctional or higher functional isocyanate compound may also be used in addition to the diisocyanate component.

The same dihydric alcohols usable for the polyester resin as described above can be adopted for the diol component that can be used for the polyurethane resin.

The toner particle may contain a colorant. The colorant can be exemplified by known organic pigments, organic dyes, and inorganic pigments, and black colorants can be exemplified by carbon black and magnetic bodies. In addition to these, those colorants conventionally used in toners may be used.

The inorganic fine particles described in the preceding may also be used as the colorant.

The toner particle configuration may be that of a core/shell structure in which a shell is formed on the surface of a core particle.

The method for forming this core/shell structure is not particularly limited; however, for example, a polymer layer functioning as the shell may be formed by the suspension polymerization, in the presence of a core particle, of polymerizable monomer for the shell.

Monomer that forms a polymer having a glass transition temperature above 70° C., e.g., styrene, methyl methacrylate, and so forth, is preferably used as the polymerizable monomer for shell formation, and a single one of these or a combination of two or more may be used. Methyl methacrylate is more preferred.

In order to improve toner storability, the glass transition temperature of the polymer obtained from the polymerizable monomer for shell formation is preferably 50° C. to 120° C., more preferably 60° C. to 110° C., and still more preferably 70° C. to 105° C.

In addition, from the standpoint of heat resistance the shell may contain a thermosetting resin.

This thermosetting resin can be exemplified by the following:

melamine resins, urea resins, sulfonamide resins, glyoxal resins, guanamine resins, and aniline resins and derivatives of these resins;

polyimide resins; maleimide polymers from, e.g., bismaleimide, aminobismaleimide, or bismaleimide triazine; and resins (referred to below as aminoaldehyde resins) produced by the polycondensation of an amino group-containing compound and an aldehyde (for example, formaldehyde) as well as derivatives of aminoaldehyde resins.

The melamine resins are the polycondensates of melamine with formaldehyde. The urea resins are the polycondensates of urea and formaldehyde. The glyoxal resins are the polycondensates of formaldehyde with the reaction product of glyoxal and urea. The glyoxal resin is preferably dimethyloldihydroxyethyleneurea (DMDHEU).

The crosslinking and curing function of the thermosetting resin can be improved by the presence of the element nitrogen in the thermosetting resin. In order to increase the reactivity of the thermosetting resin, the content of the element nitrogen is preferably adjusted to from 40 mass % to 55 mass % for melamine resins, to about 40 mass % for urea resins, and to about 15 mass % for glyoxal resins.

At least one thermosetting monomer selected from the group consisting of methylolmelamine, melamine, methylolated urea, urea, benzoguanamine, acetoguanamine, and spiroguanamine can advantageously be used in the preparation of the thermosetting resin contained in the shell.

A curing agent or reaction promoter may be used for shell formation, and a polymer in which a plurality of functional groups are combined may be used for shell formation. In addition, the water-resistance of the shell can be improved using an acrylsilicone resin (graft polymer).

The thickness of the shell is preferably not more than 20 nm and is more preferably 3 nm to 20 nm. Shell formation is preferably carried out in an aqueous medium, and the material of the shell preferably has water solubility.

In order to form the shell with the thermosetting resin, preferably the core particle has an anionic character and the shell has a cationic character. By having the core particle have an anionic character, the cationic shell material can then be attracted to the core particle surface during shell formation.

Considered in greater detail, for example, the shell material, being positively charged in the aqueous medium, is electrically attracted to the core particle, which is negatively charged in the aqueous medium, and the shell layer is then formed on the core particle surface by in-situ polymerization. By proceeding in this manner, the formation of a uniform shell on the core particle surface is facilitated even without inducing an excessive dispersion of the core particles in the aqueous medium using a dispersing agent.

The toner preferably contains an external additive in order to improve the charge stability, developing performance, flowability, and durability. This external additive can be exemplified by inorganic fine particles, e.g., silica fine particles and metal oxide fine particles (e.g., alumina fine particles, titanium oxide fine particles, magnesium oxide fine particles, zinc oxide fine particles, strontium titanate fine particles, and barium titanate fine particles).

Organic fine particles including, e.g., a vinyl resin, silicone resin, or melamine resin, and organic/inorganic composite fine particles may also be used.

The content of the external additive, per 100.0 mass parts of the toner particle, is preferably from 0.1 mass parts to 4.0 mass parts and is more preferably from 0.2 mass parts to 3.5 mass parts.

The toner particle may be produced by any heretofore known method, i.e., a suspension polymerization method, emulsion aggregation method, dissolution suspension method, or pulverization method, as long as the toner particle falls within the range of the herein described constitution; however, production by the suspension polymerization method is preferred. That is, the toner particle is preferably a suspension-polymerized toner particle.

When the toner particle is produced by the suspension polymerization method, the inorganic fine particles can be segregated to the vicinity of the toner surface layer through selection, so as to satisfy the conditions of the present disclosure, of the particle diameter and content of the inorganic fine particles, the type and amount of addition of the surface treatment agent used to treat the inorganic fine particles, and the treatment method with the surface treatment agent. As a result, a high crystallinity by the crystalline resin is established in the vicinity of the surface layer and the low-temperature fixability and durability are then further improved.

For example, a polymerizable monomer composition is obtained by mixing the polymerizable monomer that will produce the binder resin including the polymer A, with the inorganic fine particles and optional other additives such as release agent, charge control agent, and so forth. This polymerizable monomer composition is then added to an aqueous medium (optionally containing a dispersion stabilizer). Particles of the polymerizable monomer composition are formed in the aqueous medium and toner particles can then be obtained by polymerizing the polymerizable monomer in these particles.

The methods used to measure the properties involved with the present disclosure are described in the following.

Method for Measuring the Contents in the Polymer A of the Monomer Units Derived from the Various Polymerizable Monomers The contents in the polymer A of the monomer units derived from the various polymerizable monomers are measured by $^1$H-NMR using the following conditions.

measurement instrument: JNM-EX400 FT-NMR instrument (JEOL Ltd.)
measurement frequency: 400 MHz
pulse condition: 5.0 μs
frequency range: 10,500 Hz
number of accumulations: 64
measurement temperature: 30° C.
sample: Preparation is carried out by introducing 50 mg of the measurement sample into a sample tube having an internal diameter of 5 mm; adding deuterochloroform ($CDCl_3$) as solvent; and dissolving in a 40° C. thermostat.

From among the peaks assigned to the constituent components of the monomer unit derived from the first polymerizable monomer in the resulting $^1$H-NMR chart, a peak is selected that is independent from the peaks assigned to the constituent components for otherwise derived monomer units, and the integration value $S_1$ of this peak is calculated.

Similarly, from among the peaks assigned to the constituent components of the monomer unit derived from the second polymerizable monomer, a peak is selected that is independent from the peaks assigned to the constituent components for otherwise derived monomer units, and the integration value $S_2$ of this peak is calculated.

When a third polymerizable monomer has been used, from among the peaks assigned to the constituent components of the monomer unit derived from the third polymerizable monomer, a peak is selected that is independent from the peaks assigned to the constituent components for otherwise derived monomer units, and the integration value $S_3$ of this peak is calculated.

The content of monomer unit derived from the first polymerizable monomer is determined as follows using the integration values $S_1$, $S_2$, and $S_3$. $n_1$, $n_2$, and $n_3$ are the number of hydrogens in the constituent component to which the peak of interest for the particular segment is assigned.

$$\text{content (mol \%) of monomer unit derived from the first polymerizable monomer}=\{(S_1/n_1)/((S_1/n_1)+(S_2/n_2)+(S_3/n_3))\}\times 100$$

The content of the monomer unit derived from the second polymerizable monomer and the content of the monomer unit derived from the third polymerizable monomer are similarly determined as follows.

$$\text{content (mol \%) of monomer unit derived from the second polymerizable monomer}=\{(S_2/n_2)/((S_1/n_1)+(S_2/n_2)+(S_3/n_3))\}\times 100$$

$$\text{content (mol \%) of monomer unit derived from the third polymerizable monomer}=\{(S_3/n_3)/((S_1/n_1)+(S_2/n_2)+(S_3/n_3))\}\times 100$$

When polymerizable monomer that does not contain the hydrogen atom in a constituent component other than the vinyl group is used for the polymer A, $^{13}$C is used for the measurement atomic nucleus using $^{13}$C-NMR; measurement is performed in single pulse mode; and the calculation is carried out proceeding as with the $^1$H-NMR.

In addition, when the toner particle is produced by suspension polymerization, the peaks for the release agent and other resins may overlap and an independent peak may not be observed. Due to this, it may then not be possible in some instances to calculate the contents of the monomer units derived from the various polymerizable monomers in the polymer A. When this is the case, a polymer A' is produced by the same suspension polymerization, but without using the inorganic fine particles, release agent, and other resins, and the analysis can then be performed taking the polymer A' as the polymer A.

Method for Calculating SP Values $SP_{12}$, $SP_{22}$, and $SP_{32}$ are determined proceeding as follows using the calculation method proposed by Fedors.

For each of the polymerizable monomers, the energy of vaporization (Δei) (cal/mol) and the molar volume (Δvi) ($cm^3$/mol) are determined from the tables given in "Polym. Eng. Sci., 14(2), 147-154 (1974)" for the atoms or atomic groups in the molecular structure, and $(4.184\times\Sigma\Delta ei/\Sigma\Delta vi)^{0.5}$ is used for the SP value $(J/cm^3)^{0.5}$.

$SP_{11}$, $SP_{21}$, and $SP_{31}$, on the other hand, are determined by this same calculation method for the atoms or atomic groups in the molecular structure residing in the state provided by cleavage of the double bond in the polymerizable monomer due to polymerization.

Method for Measuring the Weight-Average Molecular Weight (Mw) of the Polymer A

The weight-average molecular weight (Mw) of the tetrahydrofuran (THF)-soluble matter in the polymer A is measured using gel permeation chromatography (GPC) as follows.

First, the sample is dissolved in tetrahydrofuran (THF) at room temperature for 24 hours. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of 0.8 mass %. Measurement is carried out under the following conditions using this sample solution.

instrument: HLC8120 GPC (detector: RI) (Tosoh Corporation)
column: 7-column train of Shodex KF-801, 802, 803, 804, 805, 806, and 807 (Showa Denko Kabushiki Kaisha)
eluent: tetrahydrofuran (THF)
flow rate: 1.0 mL/min
oven temperature: 40.0° C.
sample injection amount: 0.10 mL A molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Method for Measuring the Melting Point of the Polymer A

The melting point of the polymer A is measured using the following conditions and a DSC Q1000 (TA Instruments).
ramp rate: 10° C./min
measurement start temperature: 20° C.
measurement end temperature: 180° C.

The melting points of indium and zinc are used for temperature correction in the instrument detection section, and the heat of fusion of indium is used for correction of the amount of heat.

Specifically, 5 mg of the sample is exactly weighed out and introduced into an aluminum pan and differential scanning calorimetric measurement is carried out. An empty silver pan is used for reference.

The peak temperature of the maximum endothermic peak in the first heating step is taken to be the melting point (° C.).

When a plurality of peaks are present, the maximum endothermic peak is taken to be the peak having the largest endothermic quantity.

Analysis of the Structure of the Coating Layer on the Inorganic Fine Particles

The measurement is carried out using the following conditions and time-of-flight secondary ion mass spectrometry (TOF-SIMS). A TRIFT-IV from ULVAC-PHI, Inc. is used as the instrumentation.
sample preparation: the inorganic fine particles are attached to an indium sheet
sample pretreatment: none
primary ion: Au ion
acceleration voltage: 30 kV
charge neutralization mode: ON
measurement mode: Negative
raster: 100 μm The structure of the inorganic fine particle surface can be elucidated by the presence/absence of peaks that represent bonding between the surface treatment agent and inorganic elements present in the inorganic fine particles.

Method for Measuring the Amount of Treatment Agent on the Inorganic Fine Particle Surface The amount of carbon per unit weight is measured using a carbon/sulfur analyzer (EMIA-320V) from Horiba, Ltd. The amount of carbon provided by this measurement is taken to be the amount of treatment agent (mass %) at the inorganic fine particle surface. The measurement is carried out using 0.20 g for the amount of introduction of the inorganic fine particles and a mixture of tungsten and tin for the combustion improver.

Method for Measuring the Content of Inorganic Fine Particles in the Toner

The measurement is carried out as follows using a "product name: TGA7, from PerkinElmer Inc." thermal analyzer. The toner is heated from normal temperature to 900° C. under a nitrogen atmosphere at a ramp rate of 25° C./minute. The mass loss in mass % between 100° C. and 750° C. is taken to be the amount of binder resin, and the remaining mass is taken to be approximately equal to the amount of the inorganic fine particles.

When the toner has an external additive, measurement of the inorganic fine particle content is carried out after the external additive has been removed using the following methods.

For the Case of a Magnetic Toner 5 g of the toner is weighed into 200-mL lid-equipped plastic cup using a precision balance; 100 mL of methanol is added; and dispersion is performed for 5 minutes using an ultrasound disperser. The toner is attracted with a neodymium magnet and the supernatant is discarded. This process of dispersion with methanol and discarding the supernatant is carried out three times; the following materials are added and light mixing is performed; and standing at quiescence for 24 hours is then carried out.

10% NaOH 100 mL
several drops of "Contaminon N" (a 10 mass % aqueous solution of a neutral pH 7 detergent for cleaning precision measurement instrumentation, including a nonionic surfactant, anionic surfactant, and organic builder, from Wako Pure Chemical Industries, Ltd.)

Separation is then performed again using a neodymium magnet. Rinsing with distilled water is repeated at this point until no NaOH remains. The recovered particles are thoroughly dried using a vacuum dryer. This procedure yields toner particles from which the external additive has been removed by dissolution.

For the Case of a Nonmagnetic Toner

A sucrose concentrate is prepared by the addition of 160 g of sucrose (Kishida Chemical Co., Ltd.) to 100 mL of deionized water and dissolution while heating on a water bath. 31 g of this sucrose concentrate and 6 mL of Contaminon N are introduced into a centrifugal separation tube to prepare a dispersion. 1 g of the toner is added to this dispersion, and clumps of the toner are broken up using, for example, a spatula. The centrifugal separation tube is shaken for 20 minutes at 350 excursions per minute using a "KM Shaker" (model: V.SX) from Iwaki Industry Co., Ltd.

After shaking, the solution is transferred into a glass tube (50 mL) for swing rotor service and centrifugal separation is carried out at 3500 rpm for 30 minutes using a centrifugal separator. After this centrifugal separation, the toner particles are present in the uppermost layer in the glass tube and the external additive is present in the aqueous solution side of the lower layer. The upper layer is recovered and washed with 100 mL of deionized water, followed by suction filtration to recover the toner particles. As necessary, this procedure may be carried out repeatedly and, after the external additive has been thoroughly separated from the toner particles, the dispersion is dried and the toner particles are collected.

Method for Measuring the Moisture Adsorption/Desorption of the Inorganic Fine Particles The moisture adsorption/desorption characteristics of the inorganic fine particles are measured using a "BELSORP-aqua3 High Precision Vapor Adsorption Instrument" (Nippon Bel Co., Ltd.). With the "BELSORP-aqua3 High Precision Vapor Adsorption Instrument", a solid-gas equilibrium is achieved under conditions in which only the gas of interest (water for the present disclosure) is present, and the mass of the solid and the vapor pressure are measured at this time.

First, approximately 1 g of the sample is introduced into the sample cell and is degassed at room temperature for 24 hours at 100 Pa or below. After the completion of degassing, the sample weight is exactly weighed followed by setting in the main unit of the instrument and measurement under the following conditions.

air thermostatted chamber temperature: 80.0° C.
adsorption temperature: 30.0° C.
adsorbent: $H_2O$
equilibration time: 500 sec
temperature hold: 60 min
saturation vapor pressure: 4.245 kPa
sample tube exhaust rate: normal
introduction pressure, initial amount of introduction: 0.20 $cm^3$ (STP)·$g^{-1}$
measurement relative pressure P/P0 (from adsorption process to desorption process is measured): 0.05, 0.10, 0.15, 0.25, 0.35, 0.45, 0.55, 0.65, 0.75, 0.85, 0.90, 0.95, 1.00

The measurement is carried out using these conditions; the moisture adsorption·desorption isotherms are constructed for a temperature of 30.0° C.; and the amount of moisture adsorption Z (mg/g) at a humidity of 100% RH (measurement relative pressure of 1.00) in the adsorption process is calculated.

In addition, the following are also calculated: the value of the amount of moisture adsorption X (mg/g) in the adsorption process at a temperature of 30.0° C. and a relative humidity of 10% RH (measurement relative pressure of 0.10); the value, after the application of a humidity history to a humidity of 100% RH (measurement relative pressure of 1.00), of the amount of moisture adsorption Y (mg/g) in the desorption process at a temperature of 30.0° C. and a relative humidity of 10% RH (measurement relative pressure of 0.10); and their difference, i.e., the value of Y−X.

Method for Measuring the Number-Average Primary Particle Diameter of the Inorganic Fine Particles The number-average primary particle diameter of the inorganic fine particles is measured using a "JEM-2800" transmission electron microscope (JEOL Ltd.).

Specifically, the toner to be observed is thoroughly dispersed in an epoxy resin, followed by curing for two days in an atmosphere with a temperature of 40° C. to obtain a cured product. Thin-section samples of this cured product are made using an ultrasound ultramicrotome (EM5, Leica), and the long diameter of the primary particles of 100 randomly selected inorganic fine particles is measured using a transmission electron microscope (TEM) in a field of view magnified by a maximum of 50,000×. The average value of the measured long diameters is taken to be the number-average particle diameter. Image Pro PLUS (Nippon Roper K.K.) is used for the measurement.

When the inorganic fine particles as such can be acquired, the number-average particle diameter may be measured by measuring these inorganic fine particles as such using the method described above.

EXAMPLES

The present disclosure is described in greater detail in the following using examples and comparative examples, but the present disclosure is in no way limited thereto or thereby. The "parts" used in the following formulations are on a mass basis unless specifically indicated otherwise.

Preparation of Urethane Group-Bearing Monomer 50.0 parts of methanol was introduced into a reactor. This was followed by the dropwise addition of 5.0 parts of Karenz MOI [2-isocyanatoethyl methacrylate] (Showa Denko K. K.) at 40° C. while stirring. After the completion of the dropwise addition, stirring was carried out for 2 hours while maintaining 40° C. The unreacted methanol was then removed using an evaporator to yield a urethane group-bearing monomer.

Preparation of Urea Group-Bearing Monomer 50.0 parts of dibutylamine was introduced into a reactor. This was followed by the dropwise addition of 5.0 parts of Karenz MOI [2-isocyanatoethyl methacrylate] at room temperature while stirring. Stirring was carried out for 2 hours after the completion of the dropwise addition. The unreacted dibutylamine was then removed using an evaporator to yield a urea group-bearing monomer.

Preparation of Polymer A0

The following materials were introduced under a nitrogen atmosphere into a reactor fitted with a reflux condenser, stirrer, thermometer, and nitrogen introduction line.

| | |
|---|---|
| toluene | 100.0 parts |
| monomer composition (The monomer composition was provided by mixing the following behenyl acrylate, methacrylonitrile, and styrene in the proportions indicated below.) | 100.0 parts |
| behenyl acrylate (first polymerizable monomer) | 67.0 parts (28.88 mol %) |
| methacrylonitrile (second polymerizable monomer) | 22.0 parts (53.80 mol %) |
| styrene (third polymerizable monomer) | 11.0 parts (17.33 mol %) |
| t-butyl peroxypivalate (polymerization initiator, Perbutyl PV, NOF Corporation) | 0.5 parts |

While stirring in the aforementioned reactor at 200 rpm, a polymerization reaction was run for 12 hours with heating to 70° C. to obtain a solution in which a polymer of the monomer composition was dissolved in toluene. This solution was then cooled to 25° C. followed by the introduction of the solution while stirring into 1000.0 parts of methanol to precipitate methanol-insoluble matter. The resulting methanol-insoluble matter was filtered off and was additionally washed with methanol, followed by vacuum drying for 24 hours at 40° C. to yield a polymer A0. The polymer A0 had a weight-average molecular weight (Mw) of 68,400, an acid value of 0.0 mg KOH/g, and a melting point of 62° C.

According to the NMR analysis of polymer A0, it contained 28.88 mol % monomer unit derived from behenyl acrylate, 53.80 mol % monomer unit derived from methacrylonitrile, and 17.33 mol % monomer unit derived from styrene.

Preparation of Amorphous Resin

The following starting materials were charged to a heat-dried two-neck flask while introducing nitrogen.

| | |
|---|---|
| polyoxypropylene(2.2)-2,2-bis(4-hydroxyphenyl)propane | 30.0 parts |
| polyoxyethylene(2.2)-2,2-bis(4-hydroxyphenyl)propane | 33.0 parts |
| terephthalic acid | 21.0 parts |
| dodecenylsuccinic acid | 15.0 parts |
| dibutyltin oxide | 0.1 parts |

After nitrogen replacement within the system using a reduced pressure procedure, stirring was performed for 5 hours at 215° C. This was followed by gradually raising the temperature to 230° C. under reduced pressure while continuing to stir and holding for an additional 2 hours. Once a viscous condition occurred, the reaction was stopped by air cooling to synthesize an amorphous resin that was an amorphous polyester. This amorphous resin had a number-average molecular weight (Mn) of 5,200, a weight-average molecular weight (Mw) of 23,000, and a glass transition temperature (Tg) of 55° C.

Inorganic Fine Particle B1 Production Example

Method of Producing Substrate 1

1.0 equivalent, with reference to the iron ion, of a sodium hydroxide solution (contained sodium hexametaphosphate at 1 mass % as P with reference to Fe) was mixed into an aqueous ferrous sulfate solution to prepare an aqueous solution that contained ferrous hydroxide. While maintaining the aqueous solution at pH 9, air was bubbled in and an oxidation reaction was run at 80° C. to prepare a slurry in which seed crystals were produced.

An aqueous ferrous sulfate solution was then added to the slurry so as to provide 1.0 equivalents with reference to the initial amount of alkali (sodium component in the sodium hydroxide). The slurry was held at pH 8 and an oxidation reaction was run while bubbling in air; the pH was adjusted to 6 at the end of the oxidation reaction; and washing with water and drying yielded the substrate 1.

Method for Treating the Surface of Substrate 1

10,000 parts of the substrate 1 were introduced into a Simpson Mix Muller (Model MSG-0L, SINTOKOGIO, LTD.) and a milling process was carried out for 30 minutes.

This was followed by the introduction into the same machine of 95 parts of n-decyltrimethoxysilane as the surface treatment agent, and inorganic fine particle B1 was obtained by operation for 1 hour. The properties of the obtained inorganic fine particle B1 are given in Table 1.

Inorganic Fine Particle B2 Production Example

Method of Producing Substrate 2

589.6 parts of methanol, 42.0 parts of water, and 47.1 parts of 28 mass % aqueous ammonia were added with mixing to a 3-L glass reactor equipped with a stirrer, dropping funnels, and a thermometer. The resulting solution was adjusted to 35° C., and, while stirring, the addition of 1100.0 parts of tetramethoxysilane was begun at the same time as the addition of 395.2 parts of 5.4 mass % aqueous ammonia. The tetramethoxysilane was added dropwise over 6 hours and the aqueous ammonia was added dropwise over 5 hours. After completion of the dropwise addition, stirring was continued for an additional 0.5 hours to carry out hydrolysis and yield a methanol-water dispersion of hydrophilic spherical sol-gel silica fine particles.

An ester adapter and a condenser were then mounted on the glass reactor and the dispersion was thoroughly dried at 80° C. under reduced pressure. This step was carried out several tens of times, and the resulting particles were ground using a Pulverizer (Hosokawa Micron Corporation) and processed on a mesh having an aperture of 30 μm to remove coarse particulates and yield a substrate 2.

Method for Treating the Surface of Substrate 2

A surface treatment was carried out on the substrate 2 using the same method as for the inorganic fine particle B1. The type and amount of the surface treatment agent are given in Table 1. The properties of the obtained inorganic fine particle B2 are given in Table 1.

Inorganic Fine Particle B3 Production Example

Method of Producing Substrate 3

Coke and a pulverizate of a synthetic rutile were mixed as starting materials; this was introduced into a fluid bed chlorination furnace heated to around a temperature of 1,000° C.; and an exothermic reaction was run with co-fed chlorine gas to obtain a crude titanium tetrachloride. Purification was performed by separating the impurities from the resulting crude titanium tetrachloride to obtain an aqueous titanium tetrachloride solution. While holding this aqueous titanium tetrachloride solution at room temperature, an aqueous sodium hydroxide solution was added to adjust the pH to 7.0 and cause the precipitation of colloidal titanium hydroxide. Ageing was then carried out for 2.5 hours at a temperature of 62° C. to provide a slurry of titanium oxide base particles having a rutile nucleus. This was followed by filtration and washing; the resulting wet cake was heat treated for 24 hours at 120° C.; and milling was performed followed by processing on a mesh having an aperture of 50 μm to remove coarse particulates and yield a substrate 3.

Method for Treating the Surface of Substrate 3

A surface treatment was carried out using the same method as for the inorganic fine particle B1. The type and amount of the surface treatment agent are given in Table 1. The properties of the obtained inorganic fine particle B3 are given in Table 1.

Inorganic Fine Particle B4 Production Example

Method of Producing Substrate 4

Aluminum hydroxide was introduced into a stainless steel autoclave, and the temperature was raised to 1500° C. with the autoclave sealed and this temperature was held for 3 hours. The resulting particles were ground with a ball mill and processed on a mesh with an aperture of 50 μm to remove the coarse particulates and provide substrate 4.

Method for Treating the Surface of Substrate 4

A surface treatment was carried out using the same method as for the inorganic fine particle B1. The type and amount of the surface treatment agent are given in Table 1. The properties of the obtained inorganic fine particle B4 are given in Table 1.

Inorganic Fine Particle B5 Production Example

Method of Producing Substrate 5

9.5 L of an aqueous suspension (10%) of slaked lime (calcium hydroxide: $Ca(OH)_2$) was introduced into a 45-L pressure apparatus and calcium carbonate particles were synthesized by bubbling with carbon dioxide gas. 25° C. was used for the reaction temperature and 100%-pure carbon dioxide gas (bubbling rate: 10 L/min) was used for the carbon dioxide gas, and the reaction was stopped at the stage at which the pH of the reaction solution reached 7. The resulting slurry was processed on a mesh with an aperture of 50 μm to remove the coarse particulates and was dried to provide substrate 5.

Method for Treating the Surface of Substrate 5

A surface treatment was carried out using the same method as for the inorganic fine particle B1. The type and amount of the surface treatment agent are given in Table 1. The properties of the obtained inorganic fine particle B5 are given in Table 1.

Inorganic Fine Particles B6 to B8 and B10 Production Example

A surface treatment was carried out on the substrate 1 using the same method as for the inorganic fine particle B1. The type and amount of the surface treatment agent are given in Table 1. The properties of the obtained inorganic fine particles B6 to B8 and B10 are given in Table 1.

Inorganic Fine Particle B9 Production Example

The substrate 1 was used the inorganic fine particle B9. The properties are given in Table 1.

Inorganic Fine Particle B11 Production Example

The surface treatment agent indicated in Table 1 was diluted with 200 parts of toluene to give a solids fraction of 10 mass %. This was thoroughly mixed to prepare a coating resin solution.

100 parts of the substrate 1 was added to 32 parts of the coating resin solution and nitrogen was introduced while reducing the pressure and heating to a temperature of 65° C. was carried out, and stirring was performed using a universal mixer agitator (Fuji Paudal Co., Ltd.). While stirring, the coating resin solution was introduced in five additions (6.4 parts per addition) and the solvent was removed. After cooling to room temperature, the resulting surface-treated inorganic fine particles were transferred to a *Julia* Mixer (Tokuju Corporation) and were heat treated for 2 hours at 160° C. under a nitrogen atmosphere. The coarse particulates were removed by processing on a mesh with an aperture of 50 μm to provide inorganic fine particle B11. The properties of the resulting inorganic fine particle B11 are shown in Table 1.

Toner 1 Production Example

Toner Production by Suspension Polymerization

Toner Particle 1 Production 850 mass parts of an aqueous 0.1 mol/L $Na_3PO_4$ solution was added to a vessel equipped with a ClearMix high-speed stirrer (M Technique Co., Ltd.), and the temperature was raised to 60° C. while stirring at a rotational peripheral velocity of 33 m/s. To this was added 68 mass parts of an aqueous 1.0 mol/L $CaCl_2$ solution to prepare an aqueous medium that contained the microtine sparingly water-soluble dispersing agent $Ca_3(PO_4)_2$.

A solution was also prepared by mixing and dissolving the following materials using a propeller stirrer. The constitution and properties of the inorganic fine particles that were used are given in Table 1. A stirrer rotation rate of 100 r/min was used in the mixing of these materials. The mixture was prepared from the following:

| | |
|---|---|
| monomer composition (The monomer composition was provided by mixing the following behenyl acrylate, methacrylonitrile, and styrene in the proportions indicated below.) | 100.0 parts |
| behenyl acrylate (first polymerizable monomer) | 67.0 parts (28.88 mol %) |
| methacrylonitrile (second polymerizable monomer) | 22.0 parts (53.80 mol %) |
| styrene (third polymerizable monomer) | 11.0 parts (17.33 mol %) |
| inorganic fine particle B1 | 65.0 parts |
| charge control agent (aluminum di-t-butylsalicylate) | 0.7 parts |
| release agent (product name: HNP-51, melting point = 78° C., Nippon Seiro Co., Ltd.) | 10.0 parts |
| toluene | 100.0 parts |

This mixture was introduced into an attritor (Nippon Coke & Engineering Co., Ltd.), and a starting material dispersion was obtained by dispersing for 2 hours at 200 rpm using zirconia beads with a diameter of 5 mm.

Otherwise, 735.0 parts of deionized water and 16.0 parts of trisodium phosphate (dodecahydrate) were added to a vessel outfitted with a Homomixer high-speed stirrer (PRIMIX Corporation) and a thermometer, and the temperature was raised to 60° C. while stirring at 12,000 rpm. To this was added an aqueous calcium chloride solution of 9.0 parts calcium chloride (dihydrate) dissolved in 65.0 parts of deionized water, and stirring was carried out for 30 minutes at 12,000 rpm while maintaining 60° C. To this was added 10% hydrochloric acid to adjust the pH to 6.0 and obtain an aqueous medium that contained a dispersion stabilizer.

The starting material dispersion was transferred to a vessel outfitted with a stirrer and thermometer, and the temperature was raised to 60° C. while stirring at 100 rpm. To this was added 8.0 parts of the polymerization initiator t-butyl peroxypivalate (Perbutyl PV, NOF Corporation); stirring was performed for 5 minutes at 100 rpm while holding at 60° C.; and this was introduced into the aqueous medium that was being stirred at 12,000 rpm with the high-speed stirrer. A granulation solution was obtained by continuing to stir for 20 minutes at 12,000 rpm with the high-speed stirrer while holding at 60° C.

The granulation solution was transferred to a reactor outfitted with a reflux condenser, stirrer, thermometer, and nitrogen introduction line, and the temperature was raised to 70° C. while stirring at 150 rpm under a nitrogen atmosphere. A polymerization reaction was run for 10 hours at 150 rpm while holding at 70° C. This was followed by removal of the reflux condenser from the reactor; raising the temperature of the reaction solution to 95° C.; and removing the toluene by stirring for 5 hours at 150 rpm while holding at 95° C. to yield a toner particle dispersion.

The resulting toner particle dispersion was cooled to 20° C. while stirring at 150 rpm, and, while maintaining this stirring in this condition, dilute hydrochloric acid was then added to bring the pH to 1.5 and dissolve the dispersion stabilizer. The solid fraction was filtered off and thoroughly washed with deionized water, followed by vacuum drying for 24 hours at 40° C. to obtain a toner particle 1 containing a polymer A1 of the monomer composition.

In addition, a polymer A1' was obtained proceeding entirely as in the Toner Particle 1 Production method, but without using the inorganic fine particles, charge control agent, and release agent.

The polymer A1' had a weight-average molecular weight (Mw) of 56,000 and had a melting point of 62° C.

According to the NMR analysis of polymer A1', it contained 28.88 mol % monomer unit derived from behenyl acrylate, 53.80 mol % monomer unit derived from methacrylonitrile, and 17.33 mol % monomer unit derived from styrene.

The polymer A1 and polymer A1' were assumed to have the same properties because they were produced in the same manner.

Toner 1 Preparation 0.5 parts of a hydrophobed colloidal silica (product name: R-202, Degussa) was added to 100 parts of the obtained toner particle 1 and a toner 1 was prepared by mixing using a Henschel mixer.

Toners 2 to 24, 29 to 36, 43 to 45, 49, and 50 Production Example

Toner particles 2 to 24, 29 to 36, 43 to 45, 49, and 50 were obtained proceeding entirely as in the Toner 1 Production Example, but changing the type and number of parts of addition of the polymerizable monomer and inorganic fine particles used as indicated in Table 2.

External addition was also carried out as in the Toner 1 Production Example to obtain toners 2 to 24, 29 to 36, 43 to 45, 49, and 50. The properties of toners 2 to 24, 29 to 36, 43 to 45, 49, and 50 are given in Table 3.

Toners 25 to 28 and 46 Production Example

Toner particles 25 to 28 and 46 were obtained proceeding entirely as in the Toner 1 Production Example, but adding 6.5 parts of carbon black during mixing and dissolution of the materials using the propeller stirrer.

External addition was also carried out as in the Toner 1 Production Example to obtain toners 25 to 28 and 46. The properties of toners 25 to 28 and 46 are given in Table 3.

Toner 37 Production Example

[Production of Toner by Emulsion Aggregation]

(Preparation of a Polymer Dispersion)

| | |
|---|---|
| toluene | 300.0 parts |
| polymer A0 | 100.0 parts |

These materials were weighed out and mixed and dissolution was carried out at 90° C.

Separately, 5.0 parts of sodium dodecylbenzenesulfonate and 10.0 parts of sodium laurate were added to 700.0 parts of deionized water and dissolution was performed with heating at 90° C. The aforementioned toluene solution and the aqueous solution were then mixed and stirring was carried out at 7,000 rpm using a T. K. Robomix ultrahigh-speed stirrer (PRIMIX Corporation). Emulsification was also performed at a pressure of 200 MPa using a Nanomizer high-pressure impact-type disperser (Yoshida Kikai Co., Ltd.). This was followed by removal of the toluene using an evaporator and adjustment of the concentration with deionized water to obtain a polymer dispersion having a polymer fine particle concentration of 20%.

The 50% particle diameter (D50) on a volume basis of the polymer fine particles was measured at 0.40 μm using a Nanotrac UPA-EX150 dynamic light-scattering particle size distribution analyzer (Nikkiso Co., Ltd.).

Preparation of Release Agent Dispersion 1

| | |
|---|---|
| release agent (HNP-51, melting point = 78° C., Nippon Seiro Co., Ltd.) | 100.0 parts |
| Neogen RK anionic surfactant (Dai-ichi Kogyo Seiyaku Co., Ltd.) | 5.0 parts |
| deionized water | 395.0 parts |

The preceding materials were weighed and introduced into a mixing container equipped with a stirrer and were heated to 90° C., and a dispersion treatment was then carried out for 60 minutes by circulation to a ClearMix W-Motion (M Technique Co., Ltd.). The following dispersion conditions were used.

rotor outer diameter=3 cm clearance=0.3 mm rotor rotation rate=19,000 r/min screen rotation rate=19,000 r/min After the dispersion treatment, cooling to 40° C. was carried out using cooling process conditions of a rotor rotation rate of 1,000 r/min, a screen rotation rate of 0 r/min, and a cooling rate of 10° C./min, to obtain a release agent dispersion 1 having a 20% concentration of release agent fine particle 1.

The 50% particle diameter (D50) on a volume basis of release agent fine particle 1 was measured at 0.15 μm using a Nanotrac UPA-EX150 dynamic light-scattering particle size distribution analyzer (Nikkiso Co., Ltd.).

Preparation of an Inorganic Fine Particle Dispersion

| | |
|---|---|
| inorganic fine particle B1 | 50.0 parts |
| Neogen RK anionic surfactant (Dai-ichi Kogyo Seiyaku Co., Ltd.) | 7.5 parts |
| deionized water | 442.5 parts |

These materials were weighed out and mixed and dispersion was performed for approximately 1 hour using a Nanomizer high-pressure impact-type disperser (Yoshida Kikai Co., Ltd.) to obtain an inorganic fine particle dispersion 1 having an inorganic fine particle concentration of 10 mass %.

Toner 37 Production

| | |
|---|---|
| polymer dispersion | 500.0 parts |
| release agent dispersion 1 | 50.0 parts |
| inorganic fine particle dispersion 1 | 650.0 parts |
| deionized water | 160.0 parts |

These materials were introduced into a round stainless steel flask and were mixed. Dispersion was then carried out for 10 minutes at 5,000 r/min using an Ultra-Turrax T50 homogenizer (IKA). The pH was adjusted to 3.0 by adding a 1.0% aqueous nitric acid solution; then, using a stirring blade and a heating water bath, heating to 58° C. was carried out while adjusting the rotation rate as appropriate so as to stir the mixture. The volume-average particle diameter of the aggregated particles that formed was monitored as appropriate using a Coulter Multisizer III, and, at the point at which 6.0 μm aggregated particles had been formed, the pH was brought to 9.0 using a 5% aqueous sodium hydroxide solution. Stirring was then continued while heating to 75° C. The aggregated particles were fused by holding for 1 hour at 75° C.

Polymer crystallization was then promoted by cooling to 50° C. and holding for 3 hours.

This was followed by cooling to 25° C., filtration and solid-liquid separation, and then washing with deionized water. After the completion of washing, drying using a vacuum dryer yielded a toner particle 37 having a weight-average particle diameter (D4) of 6.07 μm.

Toner 37 was obtained by carrying out external addition as described in the Toner 1 Production Example on the toner particle 37. The properties of the toner 37 are given in Table 3.

Toner 38 Production Example

Toner Production by Dissolution Suspension

Fine Particle Dispersion 1 Preparation 683.0 parts of water, 11.0 parts of sodium methacrylic acid/ethylene oxide (EO) adduct sulfate (Eleminol RS-30, Sanyo Chemical Industries, Ltd.), 130.0 parts of styrene, 138.0 parts of methacrylic acid, 184.0 parts of n-butyl acrylate, and 1.0 parts of ammonium persulfate were introduced into a reactor fitted with a stirring rod and a thermometer, and a white suspension was obtained upon stirring for 15 minutes at 400 rpm. Heating was carried out and the temperature in the system was raised to 75° C. and a reaction was carried out for 5 hours.

An additional 30.0 parts of a 1% aqueous ammonium persulfate solution was added and a fine particle dispersion 1 of a vinyl polymer was obtained by ageing for 5 hours at 75° C. The 50% particle diameter (D50) on a volume basis of fine particle dispersion 1 was measured at 0.15 μm using a Nanotrac UPA-EX150 dynamic light-scattering particle size distribution analyzer (Nikkiso Co., Ltd.).

Preparation of an Inorganic Fine Particle Dispersion 2

| | |
|---|---|
| inorganic fine particle B1 | 100.0 parts |
| ethyl acetate | 150.0 parts |
| glass beads (1 mm) | 200.0 parts |

These materials were introduced into a heat-resistant glass vessel; dispersion was performed for 5 hours using a paint shaker; and the glass beads were removed using a nylon mesh to yield an inorganic fine particle dispersion 2. The 50% particle diameter (D50) on a volume basis of the inorganic fine particle dispersion was measured at 0.20 μm using a Nanotrac UPA-EX150 dynamic light-scattering particle size distribution analyzer (Nikkiso Co., Ltd.).

Preparation of Release Agent Dispersion 2

| | |
|---|---|
| release agent (HNP-51, melting point = 78° C., Nippon Seiro Co., Ltd.) | 20.0 parts |
| ethyl acetate | 80.0 parts |

The preceding were introduced into a sealable reactor and were stirred and heated at 80° C. Then, while gently stirring the system at 50 rpm, cooling to 25° C. was performed over 3 hours to yield a milky white liquid.

This solution was introduced into a heat-resistant vessel together with 30.0 parts of glass beads having a diameter of 1 mm; dispersion was carried out for 3 hours using a paint shaker (Toyo Seiki Seisaku-sho Ltd.); and the glass beads were removed using a nylon mesh to yield a release agent dispersion 2. The 50% particle diameter (D50) on a volume basis of release agent dispersion 2 was measured at 0.23 μm using a Nanotrac UPA-EX150 dynamic light-scattering particle size distribution analyzer (Nikkiso Co., Ltd.).

Preparation of Oil Phase

| | |
|---|---|
| polymer A0 | 100.0 parts |
| ethyl acetate | 85.0 parts |

These materials were introduced into a beaker and stirring was carried out for 1 minute at 3,000 rpm using a Disper (Tokushu Kika Kogyo Co., Ltd.).

release agent dispersion 2 (20% solids) 50.0 parts inorganic fine particle dispersion 2 (40% solids) 162.5 parts ethyl acetate 5.0 parts These materials were introduced into a beaker and an oil phase was prepared by stirring for 3 minutes at 6,000 rpm using a Disper (Tokushu Kika Kogyo Co., Ltd.).

Preparation of Aqueous Phase

| | |
|---|---|
| fine particle dispersion 1 | 15.0 parts |
| aqueous solution of sodium dodecyldiphenyl ether disulfonate (Eleminol MON7, Sanyo Chemical Industries, Ltd.) | 30.0 parts |
| deionized water | 955.0 parts |

These materials were introduced into a beaker and an aqueous phase was prepared by stirring for 3 minutes at 3,000 rpm using a Disper (Tokushu Kika Kogyo Co., Ltd.).

Toner 38 Production

The oil phase was introduced into the aqueous phase and dispersion was carried out for 10 minutes at a rotation rate of 10,000 rpm using a T. K. Homomixer (Tokushu Kika Kogyo Co., Ltd.). This was followed by solvent removal for 30 minutes at 30° C. under a reduced pressure of 50 mmHg. Filtration was then performed, and the process of filtration and redispersion in deionized water was repeated until the conductivity of the slurry reached 100 μS to remove the surfactant and yield a filter cake.

This filter cake was vacuum dried followed by air classification to obtain a toner particle 38.

Toner 38 was obtained by carrying out external addition as described in the Toner 1 Production Example on the toner particle 38. The properties of the toner 38 are given in Table 3.

Toner 39 Production Example

Production of Toner by Pulverization

| | |
|---|---|
| polymer A0 | 100.0 parts |
| inorganic fine particle B1 | 65.0 parts |
| release agent (HNP-51, melting point = 78° C., Nippon Seiro Co., Ltd.) | 2.0 parts |
| charge control agent (T-77, Hodogaya Chemical Co., Ltd.) | 2.0 parts |

These materials were pre-mixed using an FM mixer (Nippon Coke & Engineering Co., Ltd.) followed by melt-kneading with a twin-screw kneading extruder (Model PCM-30, Ikegai Ironworks Corporation).

The resulting kneaded material was cooled and coarsely pulverized using a hammer mill and was then pulverized using a mechanical pulverizer (T-250, Turbo Kogyo Co., Ltd.). The resulting finely pulverized powder was classified using a Coanda effect-based multi-grade classifier to yield a toner particle 39 having a weight-average particle diameter (D4) of 7.0 μm.

Toner 39 was obtained by carrying out external addition as described in the Toner 1 Production Example on the toner particle 39. The properties of the toner 39 are given in Table 2.

Toners 40 to 42 Production Example

Preparation of an Amorphous Resin Dispersion

| | |
|---|---|
| toluene | 300.0 parts |
| amorphous resin | 100.0 parts |

These materials were weighed out and mixed and dissolution was carried out at 90° C.

Separately, 5.0 parts of sodium dodecylbenzenesulfonate and 10.0 parts of sodium laurate were added to 700.0 parts of deionized water and dissolution was carried out with heating at 90° C.

The toluene solution was then mixed with the aqueous solution and stirring at 7,000 rpm was performed using a T. K. Robomix ultrahigh-speed stirrer (PRIMIX Corporation).

Emulsification was performed at a pressure of 200 MPa using a Nanomizer high-pressure impact-type disperser (Yoshida Kikai Co., Ltd.). The toluene was subsequently removed using an evaporator and the concentration was adjusted using deionized water to yield an amorphous resin dispersion having a 20% concentration of amorphous resin fine particles.

The 50% particle diameter (D50) on a volume basis of the amorphous resin fine particles was measured at 0.38 μm using a Nanotrac UPA-EX150 dynamic light-scattering particle size distribution analyzer (Nikkiso Co., Ltd.).

Production of Toners 40 to 42

Toner particles 40 to 42 were obtained proceeding entirely as in the Toner 37 Production Example, but changing the amount of use of the dispersions as indicated in Table 5.

Toners 40 to 42 were obtained by carrying out external addition as described in the Toner 37 Production Example on the toner particles 40 to 42. The properties of the toners 40 to 42 are given in Table 3.

Toners 47 and 48 Production Example

Toner particles 47 and 48 were obtained proceeding entirely as in the Toner 39 Production Example, but changing the type and number of parts of addition of the polymerizable monomer and inorganic fine particles used as indicated in Table 2.

External addition was also carried out as in the Toner 1 Production Example to obtain toners 47 and 48. The properties of toners 47 and 48 are given in Table 3.

Example 1

The following evaluations were performed on toner 1.

1 Evaluation of the Low-Temperature Fixability

Using a LaserJet Pro 400 M451 from HP that had been modified to enable operation with the fixing unit detached, an unfixed image with an image pattern in which 10 mm×10 mm square images were uniformly arrayed at 9 points over the entire transfer paper was output.

Fox River Bond (A4, 90 g/m$^2$) was used as the transfer paper, and 0.70 mg/cm$^2$ was used for the toner laid-on level on the transfer paper. The toner was held for 48 hours in a normal-temperature, normal-humidity (N/N) environment (23° C., 60% RH) prior to paper feed.

For the fixing unit, the fixing unit of a LaserJet P2055 from HP was removed therefrom and was used as an external fixing unit that was set up to also operate outside the laser beam printer.

The aforementioned unfixed image was fed using a process speed of 210 mm/sec with the fixation temperature at the external fixing unit being raised in 10° C. steps from a temperature of 100° C.

After passage through the external fixing unit, the fixed image was rubbed with lens cleaning paper ("Dusper®" (Ozu Paper Co., Ltd.)) under a load of 50 g/cm$^2$. The fixing onset temperature was taken to be the temperature at which the percentage decline in density pre-versus-post-rubbing was equal to or less than 20%, and the low-temperature fixability was evaluated using the following criteria.

The results of the evaluation are given in Table 6.

Evaluation Criteria

A: the fixing onset temperature is 100° C.

B: the fixing onset temperature is 110° C.

C: the fixing onset temperature is 120° C.

D: the fixing onset temperature is equal to or greater than 130° C.

2 Evaluation of the Heat-Resistant Storability

The heat-resistant storability was evaluated in order to evaluate the stability during storage.

Approximately 5 g of toner 1 was introduced into a 100-mL polypropylene cup; this was held for 10 days in an environment with a temperature of 50° C. and a humidity of 20%; and the degree of toner aggregation was measured as described below and was evaluated using the criteria given below.

The following was used as the measurement instrumentation: a "Model 1332A Digital Vibration Meter" (Showa Sokki Co., Ltd.) digital display vibration meter connected to the side surface of the vibrating platform of a "Powder Tester" (Hosokawa Micron Corporation).

The following were stacked, in sequence from the bottom, on the vibrating platform of the Powder Tester: a sieve with an aperture of 38 μm (400 mesh), a sieve with an aperture of 75 μm (200 mesh), and a sieve with an aperture of 150 μm (100 mesh). The measurement was performed as follows in a 23° C./60% RH environment.

(1) The vibration amplitude of the vibrating platform was preliminarily adjusted so as to provide 0.60 mm (peak-to-peak) for the value of the displacement on the digital display vibration meter.

(2) The toner, after its standing for 10 days as described above, was preliminarily held for 24 hours in a 23° C./60% RH environment. 5 g of the toner was then exactly weighed out and was gently loaded on the sieve having an aperture of 150 μm, which was in the uppermost position.

(3) The screens were vibrated for 15 seconds; the mass of toner retained on each sieve was then measured; and the degree of aggregation was calculated based on the following formula. The results of the evaluation are given in Table 6.

$$\text{degree of aggregation}(\%) = \{(\text{sample mass (g) on the sieve with an aperture of 150 } \mu\text{m})/5\ (\text{g})\} \times 100 + \{(\text{sample mass) (g) on the sieve with an aperature of 75 } \mu\text{m})/5\ (\text{g})\} \times 100 \times 0.6 + \{(\text{sample mass(g) on the sieve with an aperature of 38 } \mu\text{m})/5\ (\text{g})\} \times 100 \times 0.2$$

The evaluation criteria are as follows.

A: the degree of aggregation is less than 20%

B: the degree of aggregation is at least 20%, but less than 25%

C: the degree of aggregation is at least 25%, but less than 30%

D: the degree of aggregation is equal to or greater than 30%

3 Evaluation of the Durability

The toner 1 obtained as described above was loaded into a LaserJet Pro 400 M451 from HP, after which the print paper was also loaded.

Fox River Bond (A4, 90 g/m$^2$) was used for the transfer paper.

An image with a print percentage of 1% was continuously output in a 23° C./60% RH environment.

After the output of each 500 prints, a solid image and a halftone image were output, and the presence/absence of the production of vertical streaks originating with toner fusion to the control member, i.e., the production of development streaks, was visually inspected.

10,500 prints were ultimately output. The results of the evaluation are given in Table 6.

[Evaluation Criteria]
A: no vertical streaks even at 10,500 prints
B: vertical streaks occur at more than 9,000 prints, but not more than 10,500 prints
C: vertical streaks occur at more than 7,500 prints, but not more than 9,000 prints
D: vertical streaks occur at not more than 7,500 prints 4 Evaluation of the Discharged Paper Adhesion Behavior The toner 1 obtained as described above was loaded into a LaserJet Pro 400 M451 from HP, after which the print paper was also loaded.

Fox River Bond (A4, 90 g/m$^2$) was used for the transfer paper. Prior to paper feed, the toner has held for 24 hours in a high-temperature, high-humidity (H/H) environment (32.5° C., 80% RH).

Using a test chart with a print percentage of 12%, a duplex 10-sheet continuous print test was carried out in the H/H environment. Then, with the 10 sheets stacked, a load was applied for 1 hour by stacking with 7 reams (corresponded to 3,500 sheets) of the unopened transfer paper (500 sheets/ream), and the condition upon unstacking was evaluated. The results of the evaluation are given in Table 6.

A: Discharged sheet adhesion is not produced.
B: While sticking between sheets is seen, image defects after unstacking are not seen.
C: Minor image defects are seen after unstacking.
D: Significant image defects are seen after unstacking.

5 Fogging in a High-Temperature, High-Humidity Environment

The toner 1 obtained as described above was loaded into a LaserJet Pro 400 M451 from HP, after which the print paper was also loaded.

Fox River Bond (A4, 90 g/m$^2$) was used for the transfer paper. In addition, prior to paper feed, the toner has held for 3 days in a high-temperature, high-humidity (H/H) environment (32.5° C., 80% RH).

While operating in the H/H environment, a single print of an image having a white background region was printed out.

The reflectance was measured on the obtained image using a reflection densitometer (Reflectometer Model TC-6DS, Tokyo Denshoku Co., Ltd.). A green filter was used for the filter used for the measurement. The evaluation was performed using the following criteria and using Ds (%) for the poorest value of the reflectance in the white background region, Dr (%) for the reflectance of the transfer paper prior to image formation, and Dr−Ds for the fogging. The results of the evaluation are given in Table 6.

A: the fogging is less than 1.0%
B: the fogging is at least 1.0%, but less than 3.0%
C: the fogging is at least 3.0%, but less than 5.0%
D: the fogging is equal to or greater than 5.0%

6 Ghosting in a Low-Temperature, Low-Humidity Environment

The toner 1 obtained as described above was loaded into a LaserJet Pro 400 M451 from HP, after which the print paper was also loaded.

Fox River Bond (A4, 90 g/m$^2$) was used for the transfer paper. In addition, prior to paper feed, the toner has held for 3 days in a low-temperature, low-humidity (L/L) environment (15° C., 10% RH).

A ghosting evaluation image was output after 300 prints of a solid white image had been printed out in the L/L environment.

For the ghosting evaluation image, seven 15 mm×15 mm solid images were lined up in one row widthwise using a 15 mm gap at a position 5 mm from the upper edge of the transfer paper and a halftone image with a toner laid on level of 0.20 mg/cm$^2$ was placed below the solid image.

The following formula was used to calculate the difference in the reflection density, measured using a MacBeth reflection densitometer, in the halftone region of this image between the location (black print area) where the solid black image was formed at the first rotation of the developing roller and the location (nonimage area) where it was not.

"reflection density difference"=(reflection density of the image for the region which was the nonimage area in the first rotation of the developing roller)−(reflection density of the image for the region which was the black print area in the first rotation of the developing roller)

A smaller reflection density difference is regarded as being indicative of less ghosting in this evaluation. This reflection density difference was evaluated used the following criteria. The results of the evaluation are given in Table 6.

A: equal to or greater than 0.00, but less than 0.03
B: equal to or greater than 0.03, but less than 0.06
C: equal to or greater than 0.06, but less than 0.10
D: equal to or greater than 0.10, but less than 0.15
E: equal to or greater than 0.15

Examples 2 to 45

The same evaluations as for toner 1 were carried out on toners 2 to 45. The results are given in Table 6.

Comparative Examples 1 to 5

The same evaluations as for toner 1 were carried out on toners 46 to 50. The results are given in Table 6.

The abbreviations used in the tables expand as follows.

BEA: behenyl acrylate
BEMA: behenyl methacrylate
SA: stearyl acrylate
MYA: myricyl acrylate
OA: octacosyl acrylate
HA: hexadecyl acrylate
MN: methacrylonitrile
AN: acrylonitrile
HPMA: 2-hydroxypropyl methacrylate
AM: acrylamide
UT: urethane group-bearing monomer
UR: urea group-bearing monomer
AA: acrylic acid
VA: vinyl acetate
MA: methyl acrylate
St: styrene
MM: methyl methacrylate

TABLE 1

| | Surface-treated inorganic fine particle | | | | | | |
|---|---|---|---|---|---|---|---|
| Inorganic fine particle No. | Substrate | Type of treatment agent | Amount of use of treatment agent (parts) | Z (mg/g) | Y-X (mg/g) | Number-average particle diameter (μm) | *1 |
| B1 | Magnetite | n-$C_{10}H_{21}Si(CH_3O)_3$ | 95 | 3.0 | 0.30 | 0.21 | 0.94 |
| B2 | $SiO_2$ | n-$C_{10}H_{21}Si(CH_3O)_3$ | 88 | 2.8 | 0.29 | 0.08 | 0.87 |

TABLE 1-continued

| Inorganic fine particle No. | Surface-treated inorganic fine particle: Substrate | Type of treatment agent | Amount of use of treatment agent (parts) | Z (mg/g) | Y-X (mg/g) | Number-average particle diameter (μm) | *1 |
|---|---|---|---|---|---|---|---|
| B3 | $TiO_2$ | n-$C_{10}H_{21}Si(CH_3O)_3$ | 90 | 3.4 | 0.31 | 0.12 | 0.89 |
| B4 | $Al_2O_3$ | n-$C_2H_5Si(CH_3O)_3$ | 235 | 4.8 | 0.33 | 0.15 | 2.30 |
| B5 | Calcium carbonate | n-$C_{10}H_{21}Si(CH_3O)_3$ | 111 | 5.5 | 0.32 | 0.50 | 1.10 |
| B6 | Magnetite | n-$C_4H_9Si(CH_3O)_3$ | 204 | 1.5 | 0.12 | 0.21 | 2.00 |
| B7 | Magnetite | n-$C_{16}H_{33}Si(CH_3O)_3$ | 30 | 10.0 | 0.25 | 0.21 | 0.30 |
| B8 | Magnetite | n-$C_{10}H_{21}Ti(CH_3O)_3$ | 152 | 1.6 | 0.07 | 0.21 | 1.50 |
| B9 | Magnetite | — | — | 14.0 | 0.39 | 0.21 | — |
| B10 | Magnetite | n-$C_{10}H_{21}Si(CH_3O)_3$ | 113 | 1.1 | 0.05 | 0.21 | 1.12 |
| B11 | Magnetite | n-$CH_2{=}CHCOOC_{16}H_{33}$ | 320 | 12.0 | 0.26 | 0.21 | 3.10 |

*1: Amount of carbon (mass %) contained by the inorganic fine particles, with reference to the inorganic fine particles

TABLE 2

| Toner | Inorganic fine particle | | Polymer A: First polymerizable monomer | | Second polymerizable monomer | | Third polymerizable monomer | |
|---|---|---|---|---|---|---|---|---|
| No. | Type | parts | Type | parts | Type | parts | Type | parts |
| 1 | B1 | 65.0 | BEA | 67.0 | MN | 22.0 | St | 11.0 |
| 2 | B1 | 65.0 | BEA | 67.0 | AN | 22.0 | St | 11.0 |
| 3 | B1 | 65.0 | BEA | 50.0 | HPMA | 40.0 | St | 10.0 |
| 4 | B1 | 65.0 | BEA | 60.0 | VA | 30.0 | St | 10.0 |
| 5 | B1 | 65.0 | BEA | 60.0 | MA | 30.0 | St | 10.0 |
| 6 | B1 | 65.0 | BEA | 65.0 | AM | 25.0 | St | 10.0 |
| 7 | B1 | 65.0 | BEA | 61.0 | AA | 9.0 | MM | 30.0 |
| 8 | B1 | 65.0 | SA | 67.0 | MN | 22.0 | St | 11.0 |
| 9 | B1 | 65.0 | MYA | 67.0 | MN | 22.0 | St | 11.0 |
| 10 | B1 | 65.0 | OA | 67.0 | MN | 22.0 | St | 11.0 |
| 11 | B1 | 65.0 | BEA | 63.0 | MN | 7.0 | St | 23.0 |
| | | | | | AA | 7.0 | | |
| 12 | B1 | 65.0 | BEA | 63.0 | MN | 15.0 | St | 15.0 |
| | | | | | AA | 7.0 | | |
| 13 | B1 | 65.0 | BEA | 47.0 | MN | 22.0 | St | 11.0 |
| | | | SA | 20.0 | | | | |
| 14 | B1 | 65.0 | BEA | 33.0 | MN | 22.0 | St | 11.0 |
| | | | BEMA | 34.0 | | | | |
| 15 | B1 | 65.0 | BEA | 17.0 | MN | 35.0 | St | 48.0 |
| 16 | B1 | 65.0 | BEA | 30.0 | MN | 35.0 | St | 35.0 |
| 17 | B1 | 65.0 | BEA | 52.0 | MN | 26.0 | St | 22.0 |
| 18 | B1 | 65.0 | BEA | 80.0 | MN | 15.0 | St | 5.0 |
| 19 | B1 | 65.0 | BEA | 65.0 | MN | 15.0 | St | 20.0 |
| 20 | B1 | 65.0 | BEA | 65.0 | MN | 6.0 | St | 29.0 |
| 21 | B1 | 65.0 | BEA | 68.0 | MN | 32.0 | St | 0.0 |
| 22 | B1 | 65.0 | BEA | 88.0 | MN | 4.0 | St | 8.0 |
| 23 | B1 | 65.0 | BEA | 20.0 | MN | 80.0 | St | 0.0 |
| 24 | B1 | 65.0 | BEA | 17.0 | MN | 12.0 | St | 71.0 |
| 25 | B2 | 65.0 | BEA | 65.0 | MN | 6.0 | St | 29.0 |
| 26 | B3 | 65.0 | BEA | 65.0 | MN | 6.0 | St | 29.0 |

TABLE 2-continued

| Toner | Inorganic fine particle | | Polymer A: First polymerizable monomer | | Second polymerizable monomer | | Third polymerizable monomer | |
|---|---|---|---|---|---|---|---|---|
| No. | Type | parts | Type | parts | Type | parts | Type | parts |
| 27 | B4 | 65.0 | BEA | 65.0 | MN | 6.0 | St | 29.0 |
| 28 | B5 | 65.0 | BEA | 65.0 | MN | 6.0 | St | 29.0 |
| 29 | B6 | 65.0 | BEA | 65.0 | MN | 6.0 | St | 29.0 |
| 30 | B7 | 65.0 | BEA | 65.0 | MN | 6.0 | St | 29.0 |
| 31 | B8 | 65.0 | BEA | 65.0 | MN | 6.0 | St | 29.0 |
| 32 | B10 | 65.0 | BEA | 65.0 | MN | 6.0 | St | 29.0 |
| 33 | B1 | 120.0 | BEA | 65.0 | MN | 6.0 | St | 29.0 |
| 34 | B1 | 100.0 | BEA | 65.0 | MN | 6.0 | St | 29.0 |
| 35 | B1 | 50.0 | BEA | 65.0 | MN | 6.0 | St | 29.0 |
| 36 | B1 | 30.0 | BEA | 65.0 | MN | 6.0 | St | 29.0 |
| 37 | B1 | 65.0 | BEA | 67.0 | MN | 22.0 | St | 11.0 |
| 38 | B1 | 65.0 | BEA | 67.0 | MN | 22.0 | St | 11.0 |
| 39 | B1 | 65.0 | BEA | 67.0 | MN | 22.0 | St | 11.0 |
| 40 | B1 | 65.0 | BEA | 67.0 | MN | 22.0 | St | 11.0 |
| 41 | B1 | 65.0 | BEA | 67.0 | MN | 22.0 | St | 11.0 |
| 42 | B1 | 65.0 | BEA | 67.0 | MN | 22.0 | St | 11.0 |
| 43 | B1 | 65.0 | BEA | 40.0 | AN | 27.5 | St | 30.0 |
| | | | | | UT | 2.5 | | |
| 44 | B1 | 65.0 | BEA | 40.0 | AN | 27.5 | St | 30.0 |
| | | | | | UR | 2.5 | | |
| 45 | B1 | 65.0 | BEA | 67.0 | AA | 5.0 | MM | 29.0 |
| 46 | — | 0.0 | BEA | 67.0 | AA | 5.0 | MM | 29.0 |
| 47 | B9 | 65.0 | BEA | 34.0 | MN | 11.0 | St | 55.0 |
| 48 | B11 | 65.0 | BEA | 17.0 | MN | 35.0 | St | 48.0 |
| 49 | B1 | 65.0 | HA | 61.0 | MN | 26.0 | St | 13.0 |
| 50 | B1 | 65.0 | BEA | 60.0 | MM | 29.0 | — | — |
| | | | | | St | 11.0 | | |

* For toner 50 only, MM and St are handled as the second polymerizable monomer for the sake of convenience. The same applies for Table 3.

TABLE 3

| Toner No. | Inorganic fine particle No. | Polymer A: First monomer unit Type | Molar ratio mol % | Second monomer unit Type | Molar ratio mol % | Third monomer unit Type | Molar ratio mol % | $SP_{21}$-$SP_{11}$ | $SP_{22}$-$SP_{12}$ | Weight-average molecular weight Mw | Melting point ° C. | *2 |
|---|---|---|---|---|---|---|---|---|---|---|---|---|
| 1 | B1 | BEA | 28.88 | MN | 53.80 | St | 17.33 | 7.71 | 4.28 | 56000 | 62 | 100 |
| 2 | B1 | BEA | 25.28 | AN | 59.55 | St | 15.17 | 11.19 | 5.05 | 55500 | 62 | 100 |
| 3 | B1 | BEA | 26.02 | HPMA | 54.96 | St | 19.02 | 5.87 | 4.36 | 53400 | 59 | 100 |
| 4 | B1 | BEA | 26.18 | VA | 57.87 | St | 15.95 | 3.35 | 0.61 | 53600 | 56 | 100 |
| 5 | B1 | BEA | 26.18 | MA | 57.87 | St | 15.95 | 3.35 | 0.61 | 54700 | 54 | 100 |

TABLE 3-continued

| | | Polymer A | | | | | | | | | | |
|---|---|---|---|---|---|---|---|---|---|---|---|---|
| | Inorganic | First monomer unit | | Second monomer unit | | Third monomer unit | | | | Weight-average | | |
| Toner No. | fine particle No. | Type | Molar ratio mol % | Type | Molar ratio mol % | Type | Molar ratio mol % | $SP_{21}$-$SP_{11}$ | $SP_{22}$-$SP_{12}$ | molecular weight Mw | Melting point ° C. | *2 |
| 6 | B1 | BEA | 27.61 | AM | 56.87 | St | 15.53 | 21.01 | 11.43 | 56800 | 59 | 100 |
| 7 | B1 | BEA | 27.40 | AA | 21.36 | MM | 51.24 | 10.47 | 4.97 | 57100 | 57 | 100 |
| 8 | B1 | SA | 32.26 | MN | 51.24 | St | 16.50 | 7.57 | 4.25 | 55400 | 54 | 100 |
| 9 | B1 | MYA | 23.87 | MN | 57.58 | St | 18.55 | 7.88 | 4.32 | 51800 | 76 | 100 |
| 10 | B1 | OA | 24.95 | MN | 56.76 | St | 18.28 | 7.85 | 4.32 | 53400 | 78 | 100 |
| 11 | B1 | BEA | 28.16 | MN | 17.75 | St | 37.57 | 7.71 | 4.28 | 55900 | 58 | 100 |
| | | | | AA | 16.52 | | | 10.47 | 4.97 | | | |
| 12 | B1 | BEA | 26.26 | MN | 35.47 | St | 22.85 | 7.71 | 4.28 | 52900 | 61 | 100 |
| | | | | AA | 15.41 | | | 10.47 | 4.97 | | | |
| 13 | B1 | BEA | 19.96 | MN | 53.01 | St | 17.07 | 7.67 | 4.27 | 53800 | 58 | 100 |
| | | SA | 9.96 | | | | | | | | | |
| 14 | B1 | BEA | 14.30 | MN | 54.08 | St | 17.42 | 7.79 | 4.32 | 57400 | 62 | 100 |
| | | BEMA | 14.21 | | | | | | | | | |
| 15 | B1 | BEA | 4.35 | MN | 50.78 | St | 44.87 | 7.71 | 4.28 | 52100 | 54 | 100 |
| 16 | B1 | BEA | 8.42 | MN | 55.70 | St | 35.88 | 7.71 | 4.28 | 52800 | 55 | 100 |
| 17 | B1 | BEA | 18.58 | MN | 52.70 | St | 28.73 | 7.71 | 4.28 | 55300 | 59 | 100 |
| 18 | B1 | BEA | 43.63 | MN | 46.41 | St | 9.97 | 7.71 | 4.28 | 55800 | 62 | 100 |
| 19 | B1 | BEA | 29.12 | MN | 38.13 | St | 32.75 | 7.71 | 4.28 | 55200 | 62 | 100 |
| 20 | B1 | BEA | 31.70 | MN | 16.60 | St | 51.70 | 7.71 | 4.28 | 54200 | 58 | 100 |
| 21 | B1 | BEA | 27.25 | MN | 72.75 | St | 0.00 | 7.71 | 4.28 | 57500 | 62 | 100 |
| 22 | B1 | BEA | 62.89 | MN | 16.22 | St | 20.90 | 7.71 | 4.28 | 54400 | 62 | 100 |
| 23 | B1 | BEA | 4.22 | MN | 95.78 | St | 0.00 | 7.71 | 4.28 | 54800 | 55 | 100 |
| 24 | B1 | BEA | 4.93 | MN | 19.76 | St | 75.31 | 7.71 | 4.28 | 53800 | 55 | 100 |
| 25 | B2 | BEA | 31.70 | MN | 16.60 | St | 51.70 | 7.71 | 4.28 | 53900 | 58 | 100 |
| 26 | B3 | BEA | 31.70 | MN | 16.60 | St | 51.70 | 7.71 | 4.28 | 53900 | 58 | 100 |
| 27 | B4 | BEA | 31.70 | MN | 16.60 | St | 51.70 | 7.71 | 4.28 | 53900 | 58 | 100 |
| 28 | B5 | BEA | 31.70 | MN | 16.60 | St | 51.70 | 7.71 | 4.28 | 53900 | 58 | 100 |
| 29 | B6 | BEA | 31.70 | MN | 16.60 | St | 51.70 | 7.71 | 4.28 | 53900 | 58 | 100 |
| 30 | B7 | BEA | 31.70 | MN | 16.60 | St | 51.70 | 7.71 | 4.28 | 53900 | 58 | 100 |
| 31 | B8 | BEA | 31.70 | MN | 16.60 | St | 51.70 | 7.71 | 4.28 | 53900 | 58 | 100 |
| 32 | B10 | BEA | 31.70 | MN | 16.60 | St | 51.70 | 7.71 | 4.28 | 53900 | 58 | 100 |
| 33 | B1 | BEA | 31.70 | MN | 16.60 | St | 51.70 | 7.71 | 4.28 | 53900 | 58 | 100 |
| 34 | B1 | BEA | 31.70 | MN | 16.60 | St | 51.70 | 7.71 | 4.28 | 53900 | 58 | 100 |
| 35 | B1 | BEA | 31.70 | MN | 16.60 | St | 51.70 | 7.71 | 4.28 | 53900 | 58 | 100 |
| 36 | B1 | BEA | 31.70 | MN | 16.60 | St | 51.70 | 7.71 | 4.28 | 53900 | 58 | 100 |
| 37 | B1 | BEA | 28.88 | MN | 53.80 | St | 17.33 | 7.71 | 4.28 | 68400 | 62 | 100 |
| 38 | B1 | BEA | 28.88 | MN | 53.80 | St | 17.33 | 7.71 | 4.28 | 68400 | 62 | 100 |
| 39 | B1 | BEA | 28.88 | MN | 53.80 | St | 17.33 | 7.71 | 4.28 | 68400 | 62 | 100 |
| 40 | B1 | BEA | 28.88 | MN | 53.80 | St | 17.33 | 7.71 | 4.28 | 68400 | 62 | 82 |
| 41 | B1 | BEA | 28.88 | MN | 53.80 | St | 17.33 | 7.71 | 4.28 | 68400 | 62 | 52 |
| 42 | B1 | BEA | 28.88 | MN | 53.80 | St | 17.33 | 7.71 | 4.28 | 68400 | 62 | 48 |
| 43 | B1 | BEA | 11.36 | AN | 56.05 | St | 31.15 | 11.19 | 5.05 | 53600 | 55 | 100 |
| | | | | UT | 1.44 | | | 5.54 | 4.21 | | | |
| 44 | B1 | BEA | 11.42 | AN | 56.32 | St | 31.30 | 11.19 | 5.05 | 55400 | 55 | 100 |
| | | | | UR | 0.96 | | | 3.50 | 3.17 | | | |
| 45 | B1 | BEA | 32.90 | AA | 12.97 | MM | 54.13 | 10.47 | 4.97 | 52700 | 56 | 100 |
| 46 | | BEA | 32.90 | AA | 12.97 | MM | 54.13 | 10.47 | 4.97 | 52700 | 56 | 100 |
| 47 | B9 | BEA | 11.43 | MN | 20.98 | St | 67.59 | 7.71 | 4.28 | 56000 | 62 | 100 |
| 48 | B11 | BEA | 4.35 | MN | 50.78 | St | 44.87 | 7.71 | 4.28 | 56000 | 62 | 100 |
| 49 | B1 | HA | 28.65 | MN | 53.97 | St | 17.38 | 7.49 | 4.24 | 52200 | 45 | 100 |
| 50 | B1 | BEA | 28.51 | MM | 52.39 | — | — | 2.06 | 0.58 | 56500 | 52 | 100 |
| | | | | St | 19.1 | | | 1.86 | 0.25 | | | |

*2: Percentage (mass %) of polymer a in the binder resin

TABLE 4

| | | SP value of polymerizable monomer $(J/cm^3)^{0.5}$ | SP value of monomer unit $(J/cm^3)^{0.5}$ |
|---|---|---|---|
| First polymerizable monomer | Behenyl acrylate | 17.69 | 18.25 |
| | Behenyl methacrylate | 17.61 | 18.10 |
| | Stearyl acrylate | 17.71 | 18.39 |
| | Myricyl acrylate | 17.65 | 18.08 |
| | Octacosyl acrylate | 17.65 | 18.10 |
| | Hexadecyl acrylate | 17.73 | 18.47 |

TABLE 4-continued

| | | SP value of polymerizable monomer $(J/cm^3)^{0.5}$ | SP value of monomer unit $(J/cm^3)^{0.5}$ |
|---|---|---|---|
| Second polymerizable monomer | Acrylonitrile | 22.75 | 29.43 |
| | Methacrylonitrile | 21.97 | 25.96 |
| | Acrylic acid | 22.66 | 28.72 |
| | Methacrylic acid | 21.95 | 25.65 |
| | 2-hydroxypropyl methacrylate | 22.05 | 24.12 |
| | Vinyl acetate | 18.31 | 21.60 |
| | Methyl acrylate | 18.31 | 21.60 |
| | Acrylamide | 29.13 | 39.25 |
| | Urethane group-bearing monomer | 21.91 | 23.79 |
| | Urea group-bearing monomer | 20.86 | 21.74 |
| Third polymerizable monomer | Styrene | 17.94 | 20.11 |
| | Methyl methacrylate | 18.27 | 20.31 |

TABLE 5

| | Polymer dispersion Parts | Amorphous resin dispersion Parts | Release agent dispersion Parts | Inorganic fine particle dispersion Parts |
|---|---|---|---|---|
| Example 32 | 500.0 | — | 50.0 | 650.0 |
| Example 40 | 410.0 | 90.0 | 50.0 | 650.0 |

TABLE 5-continued

| | Polymer dispersion Parts | Amorphous resin dispersion Parts | Release agent dispersion Parts | Inorganic fine particle dispersion Parts |
|---|---|---|---|---|
| Example 41 | 260.0 | 240.0 | 50.0 | 650.0 |
| Example 42 | 240.0 | 260.0 | 50.0 | 650.0 |

TABLE 6

| | Toner No. | Low-temperature fixability | Heat-resistant storability Rank | Heat-resistant storability Value | Durability Rank | Discharged paper adhesion behavior | LL ghosting | HH fogging |
|---|---|---|---|---|---|---|---|---|
| Example 1 | 1 | A | A | 15 | A | A | A | A |
| Example 2 | 2 | A | A | 18 | A | A | A | A |
| Example 3 | 3 | A | B | 22 | A | B | A | A |
| Example 4 | 4 | A | B | 23 | A | C | A | A |
| Example 5 | 5 | A | C | 28 | A | C | A | A |
| Example 6 | 6 | B | B | 23 | A | A | A | A |
| Example 7 | 7 | A | C | 28 | C | C | A | A |
| Example 8 | 8 | A | C | 26 | A | A | A | A |
| Example 9 | 9 | C | A | 18 | A | A | A | A |
| Example 10 | 10 | C | A | 17 | A | A | A | A |
| Example 11 | 11 | A | B | 23 | A | A | A | A |
| Example 12 | 12 | A | A | 17 | A | A | A | A |
| Example 13 | 13 | A | B | 24 | A | A | A | A |
| Example 14 | 14 | A | A | 17 | A | A | A | A |
| Example 15 | 15 | C | C | 27 | A | B | A | A |
| Example 16 | 16 | B | C | 25 | A | B | A | A |
| Example 17 | 17 | B | B | 22 | A | A | A | A |
| Example 18 | 18 | A | A | 14 | B | A | A | A |
| Example 19 | 19 | A | A | 17 | B | A | A | A |
| Example 20 | 20 | A | B | 23 | B | A | A | A |
| Example 21 | 21 | B | A | 15 | A | A | A | A |
| Example 22 | 22 | A | B | 21 | C | A | A | A |
| Example 23 | 23 | C | C | 25 | A | C | A | A |
| Example 24 | 24 | C | C | 29 | B | C | A | A |
| Example 25 | 25 | A | B | 23 | C | A | A | A |
| Example 26 | 26 | A | B | 23 | B | B | A | A |
| Example 27 | 27 | A | C | 29 | B | C | A | A |
| Example 28 | 28 | A | B | 23 | C | C | A | A |
| Example 29 | 29 | A | B | 22 | B | A | B | A |
| Example 30 | 30 | A | B | 23 | B | B | A | C |
| Example 31 | 31 | A | B | 22 | B | C | A | C |
| Example 32 | 32 | A | B | 21 | B | B | C | A |
| Example 33 | 33 | C | A | 13 | A | A | A | A |
| Example 34 | 34 | B | A | 14 | A | A | A | A |
| Example 35 | 35 | A | A | 18 | B | A | A | A |
| Example 36 | 36 | A | A | 19 | C | B | A | B |
| Example 37 | 37 | A | A | 18 | A | A | A | A |
| Example 38 | 38 | A | A | 19 | A | A | A | A |
| Example 39 | 39 | A | A | 18 | A | A | A | A |

TABLE 6-continued

| | Toner No. | Low-temperature fixability | Heat-resistant storability Rank | Heat-resistant storability Value | Durability Rank | Discharged paper adhesion behavior | LL ghosting | HH fogging |
|---|---|---|---|---|---|---|---|---|
| Example 40 | 40 | A | A | 17 | A | A | A | A |
| Example 41 | 41 | B | A | 17 | A | A | A | A |
| Example 42 | 42 | C | A | 18 | A | A | A | A |
| Example 43 | 43 | C | C | 27 | A | B | A | A |
| Example 44 | 44 | C | C | 27 | A | B | A | A |
| Example 45 | 45 | A | C | 28 | C | C | A | A |
| Comparative Example 1 | 46 | A | C | 29 | D | D | A | A |
| Comparative Example 2 | 47 | C | C | 29 | A | D | A | C |
| Comparative Example 3 | 48 | D | D | 31 | A | C | A | C |
| Comparative Example 4 | 49 | A | D | 30 | A | A | A | A |
| Comparative Example 5 | 50 | A | D | 31 | A | D | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-099365, filed May 28, 2019 which is hereby incorporated by reference herein in its entirety.

What is claimed is:

1. A toner, comprising:

a toner particle that contains a binder resin and inorganic fine particles;

the binder resin contains a polymer A that includes a first monomer unit derived from a first polymerizable monomer selected from the group consisting of (meth) acrylate esters having an alkyl group having 18 to 36 carbons, and a second monomer unit derived from a second polymerizable monomer that is different from the first polymerizable monomer;

each of the inorganic fine particles contains a substrate containing at least one inorganic element selected from metal elements and metalloid elements, and a coating layer, wherein $$3.00 \leq (SP_{21} - SP_{11}) \leq 25.00$$

where $SP_{11}$ $(J/cm^3)^{0.5}$ is an SP value of the first monomer unit and $SP_{21}$ $(J/cm^3)^{0.5}$ is an SP value of the second monomer unit, and the coating layer has a structure represented by at least one of the group consisting of formulae (A), (B), (C) and (D)

(A)

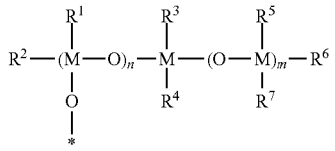

(B)

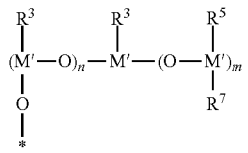

-continued (C)

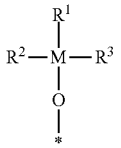

(D)

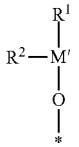

where M independently represents one or more elements selected from the group consisting of tetravalent Si, tetravalent Ti and tetravalent Zr, M' independently represents one or more elements selected from the group consisting of trivalent Ti, trivalent Zr and trivalent Al, $R^1$ independently represents an alkyl group or a derivative thereof, $R^2$ to $R^7$ independently represent a hydrogen atom, hydroxy group, —O—* or a group selected from the group consisting of alkoxy groups, alkyl groups and derivatives thereof, * represents a bonding segment to the inorganic element, and n and m independently represent a positive integer equal to or greater than 1.

2. The toner according to claim 1, wherein each of the inorganic fine particles is a reaction product of the substrate and a compound represented by formula (3)

$$R'mSiY'n \quad (3)$$

where R' represents an alkoxy group, m represents an integer of 1 to 3, Y' represents an alkyl group or a derivative thereof, and n represents an integer of 1 to 3, with the proviso that m+n=4.

3. The toner according to claim 2, wherein, R' represents an alkoxy group and Y' represents an alkyl group having 1 to 20 carbons.

4. The toner according to claim 1, wherein a content of the first monomer unit in the polymer A is 5.00 mol % to 60.00 mol % with reference to a total number of moles of all monomer units in the polymer A, and a content of the second monomer unit in the polymer A is 20.00 mol % to 95.00 mol % with reference to the total number of moles of all monomer units in the polymer A.

5. The toner according to claim 1, wherein the second polymerizable monomer is at least one member selected from the group consisting of formulae (E) and (F)

(E)

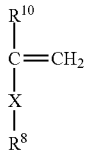

(F)

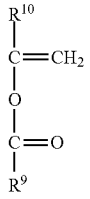

where X represents a single bond or an alkylene group having 1 to 6 carbons, $R^8$ represents —C≡N, —C(=O)NHR$^{11}$ where R$^{11}$ is a hydrogen atom or an alkyl group having 1 to 4 carbons, hydroxy group, —COOR'$^{12}$ where R$^{12}$ is an alkyl group having 1 to 6 carbons or a hydroxyalkyl group having 1 to 6 carbons, —NHCOOR$^{13}$ where R$^{13}$ is an alkyl group having 1 to 4 carbons, —NH—C(=O)—N(R$^{14}$)$_2$ where R$^{14}$ is independently a hydrogen atom or an alkyl group having 1 to 6 carbons, —COO(CH$_2$)$_2$NHCOOR$^{15}$ where R$^{15}$ is an alkyl group having 1 to 4 carbons, or —COO(CH$_2$)$_2$—NH—C(=O)—N(R$^{16}$)$_2$ where R$^{16}$ is independently a hydrogen atom or an alkyl group having 1 to 6 carbons, $R^9$ represents an alkyl group having 1 to 4 carbons, and $R^{10}$ represents a hydrogen atom or a methyl group.

6. The toner according to claim 1, wherein the second polymerizable monomer is at least one member selected from the group consisting of formulae (E) and (F)

(E)

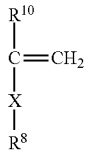

(F)

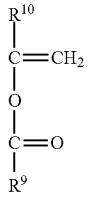

where X represents a single bond or an alkylene group having 1 to 6 carbons, $R^8$ represents a nitrile group —C≡N, —C(=O)NHR$^{11}$ where R$^{11}$ is a hydrogen atom or an alkyl group having 1 to 4 carbons, hydroxy group, —COOR$^{12}$ where R$^{12}$ is an alkyl group having 1 to 6 carbons or a hydroxyalkyl group having 1 to 6 carbons, —NH—C(=O)—N(R$^{14}$)$_2$ where R$^{14}$ is independently a hydrogen atom or an alkyl group having 1 to 6 carbons, —COO(CH$_2$)$_2$NHCOOR$^{15}$ where R$^{15}$ is an alkyl group having 1 to 4 carbons, or —COO(CH$_2$)$_2$—NH—C(=O)—N(R$^{16}$)$_2$ where R$^{16}$ is independently a hydrogen atom or an alkyl group having 1 to 6 carbons $R^9$ represents an alkyl group having 1 to 4 carbons, and $R^{10}$ represents a hydrogen atom or a methyl group.

7. The toner according to claim 1, wherein the polymer A includes a third monomer unit derived from a third polymerizable monomer that is different from both the first and second polymerizable monomers, and the third polymerizable monomer is at least one member selected from the group consisting of styrene, methyl methacrylate and methyl acrylate.

8. The toner according to claim 1, wherein the substrate is a metal oxide or a metalloid oxide.

9. The toner according to claim 1, wherein the substrate is magnetite.

10. The toner according to claim 1, wherein $$1.5 \leq Z \leq 10.0 \text{ and } Y-X \geq 0.10$$

where X is an amount of moisture adsorption (mg/g) for an adsorption curve of the inorganic fine particles at 30.0° C. and 10% relative humidity, Y is an amount of moisture adsorption (mg/g) for a desorption curve of the inorganic fine particles at 30.0° C. and 10% relative humidity, and Z is an amount of moisture adsorption (mg/g) of the inorganic fine particles at 30.0° C. and 100% relative humidity.

11. The toner according to claim 1, wherein the inorganic fine particles contain 0.30 to 2.50 mass % carbon.

12. The toner according to claim 1, wherein the toner particle is a suspension-polymerized toner particle.

13. A method of producing the toner according to claim 1, comprising the steps of:

forming in an aqueous medium a particle of a polymerizable monomer composition that contains a polymerizable monomer; and polymerizing the polymerizable monomer contained in the particle to obtain the toner particle containing polymer A obtained.

14. A toner, comprising:

a toner particle that contains a binder resin and inorganic fine particles the binder resin contains a polymer A that is a polymer of a composition containing a first polymerizable monomer selected from the group consisting of (meth) acrylate esters having an alkyl group having 18 to 36 carbons, and a second polymerizable monomer that is different from the first polymerizable monomer;

each of the inorganic fine particles contains a substrate containing at least one inorganic element selected from metal elements and metalloid elements, and a coating layer, wherein $$0.60 \leq (SP_{22}-SP_{12}) \leq 15.00$$

where $SP_{12}$ (J/cm$^3$)$^{0.5}$ is an SP value of the first polymerizable monomer and $SP_{22}$ (J/cm$^3$)$^{0.5}$ is an SP value of the second polymerizable monomer, and the coating layer has a structure represented by at least one of the group consisting of formulae (A), (B), (C) and (D)

(A)

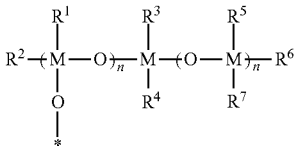

(B)

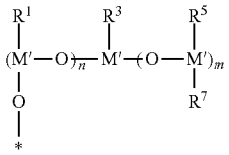

(C)

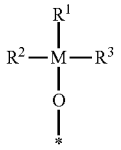

(D)

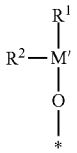

where M independently represents one or more elements selected from the group consisting of tetravalent Si, tetravalent Ti and tetravalent Zr, M' independently represents one or more elements selected from the group consisting of trivalent Ti, trivalent Zr and trivalent Al, $R^1$ independently represents an alkyl group or a derivative thereof, $R^2$ to $R^7$ independently represent a hydrogen atom, hydroxy group, —O—* or a group selected from the group consisting of alkoxy groups, alkyl groups and derivatives thereof; * represents a bonding segment to the inorganic element, and n and m independently represent a positive integer equal to or greater than 1.

15. The toner according to claim 14, wherein a content of the first polymerizable monomer in the composition is 5.00 to 60.00 mol % with reference to a total number of moles for all the polymerizable monomer in the composition, and a content of the second polymerizable monomer in the composition is 20.00 to 95.00 mol % with reference to the total number of moles for all the polymerizable monomer in the composition.

16. A toner, comprising:

a toner particle that contains a binder resin and inorganic fine particles;

the binder resin contains a polymer A that includes a first monomer unit derived from a first polymerizable monomer selected from the group consisting of (meth) acrylate esters having an alkyl group having 18 to 36 carbons, and a second monomer unit derived from a second polymerizable monomer that is different from the first polymerizable monomer; and each of the inorganic fine particles contains a substrate containing at least one inorganic element selected from metal elements and metalloid elements, wherein $$3.00 \leq (SP_{21} - SP_{11}) \leq 25.00$$

where $SP_{11}$ $(J/cm^3)^{0.5}$ is designates an SP value of the first monomer unit and $SP_{21}$ $(J/cm^3)^{0.5}$ is an SP value of the second monomer unit, and the substrate has been treated with a compound that has an alkoxy group and an alkyl group.

17. The toner according to claim 16, wherein the substrate has been treated with a compound represented by formula (3)

$$R'mSiY'n \quad (3)$$

where R' represents an alkoxy group, m represents an integer of 1 to 3, Y' represents an alkyl group or a derivative thereof, and n represents an integer of 1 to 3; with the proviso that m+n=4.

* * * * *